US010374279B2

(12) United States Patent
Matsumoto et al.

(10) Patent No.: US 10,374,279 B2
(45) Date of Patent: Aug. 6, 2019

(54) CONNECTOR DEVICE AND COMMUNICATION SYSTEM

(71) Applicant: SONY SEMICONDUCTOR SOLUTIONS CORPORATION, Kanagawa (JP)

(72) Inventors: Isao Matsumoto, Kanagawa (JP); Takayuki Mogi, Kanagawa (JP); Kenichi Kawasaki, Tokyo (JP); Tetsuya Makita, Tokyo (JP); Tatsuhito Aono, Tokyo (JP); Yu Shigeta, Tokyo (JP); Shintaro Nonaka, Saitama (JP); Takahiro Takeda, Kanagawa (JP); Yasuhiro Okada, Kanagawa (JP); Hiroyuki Yamagishi, Tokyo (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 0 days.

(21) Appl. No.: 15/556,499

(22) PCT Filed: Jan. 19, 2016

(86) PCT No.: PCT/JP2016/051404
§ 371 (c)(1),
(2) Date: Sep. 7, 2017

(87) PCT Pub. No.: WO2016/147695
PCT Pub. Date: Sep. 22, 2016

(65) Prior Publication Data

US 2018/0076501 A1 Mar. 15, 2018

(30) Foreign Application Priority Data

Mar. 17, 2015 (JP) ..... 2015-053525

(51) Int. Cl.
*H01P 5/02* (2006.01)
*H01P 1/04* (2006.01)
(Continued)

(52) U.S. Cl.
CPC ..... *H01P 5/02* (2013.01); *H01P 1/04* (2013.01); *H01P 5/026* (2013.01); *H01R 13/46* (2013.01); *H01R 13/639* (2013.01); *H01P 3/12* (2013.01)

(58) Field of Classification Search
CPC ..... H01P 15/026; H01P 1/045; H01P 3/06; H01P 5/026; H01P 1/042; H01P 1/04;
(Continued)

(56) References Cited

U.S. PATENT DOCUMENTS 6,358,086 B1 3/2002 Gallagher et al.
7,329,128 B1 2/2008 Awad
(Continued)

FOREIGN PATENT DOCUMENTS

CN 104426571 A 3/2015
EP 2645471 A1 10/2013
(Continued)

OTHER PUBLICATIONS

International Search Report and Written Opinion of PCT Application No. PCT/JP2016/051404, dated Apr. 19, 2016, 02 pages of English Translation and 07 pages of ISRWO.
(Continued)

*Primary Examiner* — Rakesh B Patel
*Assistant Examiner* — Jorge L Salazar, Jr.
(74) *Attorney, Agent, or Firm* — Chip Law Group

(57) ABSTRACT

A connector device according to the present disclosure includes a first connector section and a second connector section. The first connector section includes a waveguide for transmitting a high-frequency signal. The second connector
(Continued)

section includes a waveguide for transmitting a high-frequency signal, a yoke disposed to cover the waveguide, and a magnet forming a magnetic circuit with the yoke, and is couplable to the first connector section by the attractive force of the magnet. A communication system according to the present disclosure includes two communication devices and a connector device. The connector device has the above-described configuration and transmits a high-frequency signal between the two communication devices.

19 Claims, 20 Drawing Sheets

(51) Int. Cl.
*H01R 13/46* (2006.01)
*H01R 13/639* (2006.01)
*H01P 3/12* (2006.01)

(58) Field of Classification Search
CPC ... H01P 3/12; H01B 11/1834; H01B 11/1895; H03H 7/38; H01R 13/46; H01R 13/639
USPC ..... 333/24 R, 202, 208, 24 C
See application file for complete search history.

(56) References Cited

U.S. PATENT DOCUMENTS

| | | | | |
|---|---|---|---|---|
| 2007/0072442 | A1 | 3/2007 | DiFonzo et al. | |
| 2013/0273752 | A1 | 10/2013 | Rudisill et al. | |
| 2015/0062828 | A1 | 3/2015 | Shirai | |
| 2017/0054194 | A1* | 2/2017 | Nakata ..... | H04B 5/0012 |

FOREIGN PATENT DOCUMENTS

| | | | |
|---|---|---|---|
| JP | 59-76102 | U | 5/1984 |
| JP | 06-350301 | A | 12/1994 |
| JP | 2005-192038 | A | 7/2005 |
| JP | 2009-218794 | A | 9/2009 |
| JP | 2014-003653 | A | 1/2014 |
| JP | 2015-049717 | A | 3/2015 |
| WO | 2012/070536 | A1 | 5/2012 |

OTHER PUBLICATIONS

Extended European Search Report of EP Patent Application No. 16764526.6, dated Oct. 23, 2018, 08 pages.

* cited by examiner

CONNECTOR DEVICE AND COMMUNICATION SYSTEM

CROSS REFERENCE TO RELATED APPLICATIONS

This application is a U.S. National Phase of International Patent Application No. PCT/JP2016/051404 filed on Jan. 19, 2016, which claims priority benefit of Japanese Patent Application No. JP 2015-053525 filed in the Japan Patent Office on Mar. 17, 2015. Each of the above-referenced applications is hereby incorporated herein by reference in its entirety.

TECHNICAL FIELD

The present disclosure relates to a connector device and a communication system.

BACKGROUND ART

In a communication system for transmitting signals between two electronic devices (communication devices), an electrical connection is established through a connector device (refer, for example, to PTL 1). One example of this kind of communication system is a communication system that includes two electronic devices, namely, a mobile terminal and a freestanding expanded device called a cradle. Note that this kind of communication system is not limited to such a communication system.

CITATION LIST

Patent Literature

[PTL 1]
JP 2014-3653 A

SUMMARY

Technical Problem

A communication system described in PTL 1 employs a method of using a waveguide for connecting to a high-speed transmission path. This method is effective from the viewpoint of strength improvement for providing protection against electrical breakdown. However, connecting or disconnecting the connector device is likely to incur physical breakdown because the connector device includes a plug and a receptacle and has a so-called plug-type configuration for establishing an electrical connection. That is to say, the connector device is susceptible to physical breakdown.

In view of the above circumstances, an object of the present disclosure is to provide a connector device that is resistant to physical breakdown and exhibits increased resistance to electrical breakdown, and a communication system that establishes an electrical connection between two electronic devices through the connector device.

Solution to Problem

In order to achieve the above object, a connector device according to the present disclosure includes a first connector section and a second connector section. The first connector section has a waveguide for transmitting a high-frequency signal. The second connector section has a waveguide for transmitting a high-frequency signal, a yoke disposed to cover the waveguide, and a magnet forming a magnetic circuit with the yoke, and is couplable to the first connector section by the attractive force of the magnet.

In order to achieve the above object, a communication system according to the present disclosure includes two communication devices and a connector device. The connector device transmits a high-frequency signal between the two communication devices and includes a first connector section and a second connector section. The first connector section has a waveguide for transmitting the high-frequency signal. The second connector section has a waveguide for transmitting the high-frequency signal, a yoke disposed to cover the waveguide, and a magnet forming a magnetic circuit with the yoke, and is couplable to the first connector section by the attractive force of the magnet.

The second connector section in the above-described connector device or communication system can be coupled to the first connector section by the attractive force of the yoke. Therefore, employed coupling portions do not include any insertion/removal portion that is susceptible to physical breakdown, namely, weak in physical strength. Further, a coupling structure formed of the magnet and the yoke is employed. Consequently, while downsizing is achieved, the second connector section can easily be mounted onto and removed from (connected to and disconnected from) the first connector section, and the first connector section and the second connector section can be properly coupled to each other.

Advantageous Effects of Invention

The present disclosure not only provides increased resistance to electrical breakdown but also provides increased resistance to physical breakdown because employed coupling portions do not include any insertion/removal portion susceptible to physical breakdown and the attractive force of a magnet properly achieves coupling.

The present disclosure is not limited to the above advantages and can provide any other advantages described later in this specification. Further, the advantages described in this specification are merely described as examples. The present disclosure is not limited to those advantages and can provide additional advantages.

DESCRIPTION OF EMBODIMENT

Figure 1:
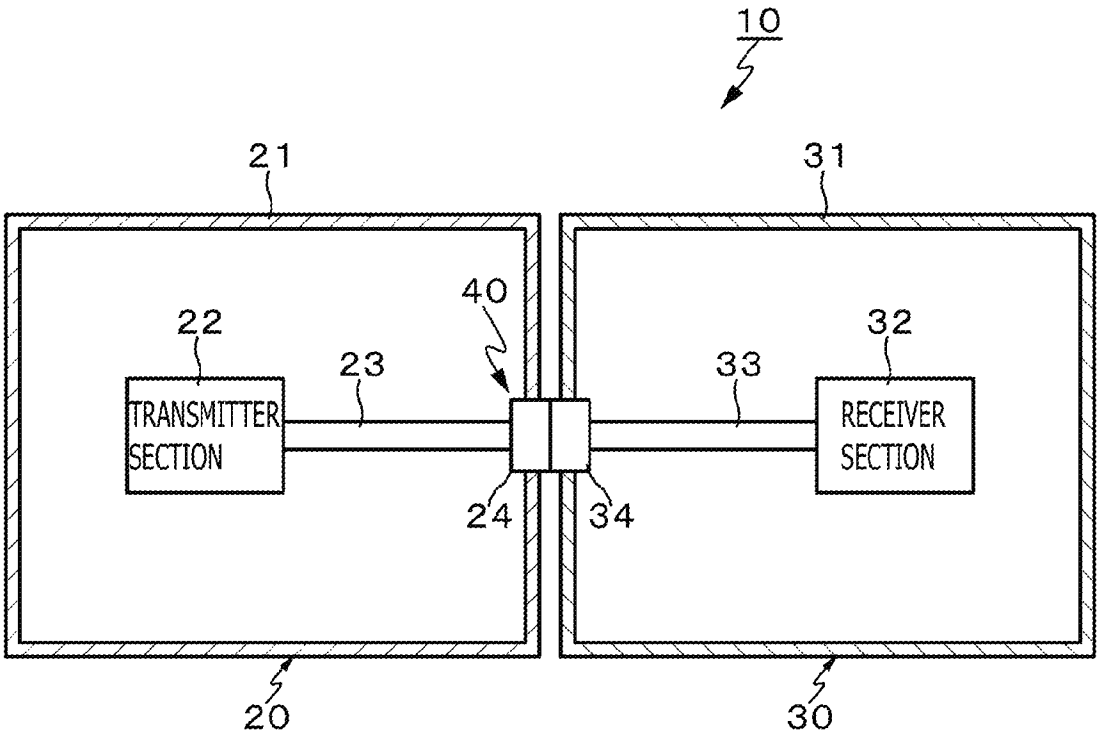
FIG. 1 is a plan view including a partial cross-sectional view that illustrates a basic configuration of a communication system according to an embodiment of the present disclosure.

An embodiment of a technology according to the present disclosure (hereinafter referred to as the "embodiment") will now be described in detail with reference to the accompanying drawings. The technology according to the present disclosure is not limited to the embodiment. Various numerical values and materials mentioned in conjunction with the embodiment are merely examples. In the following description, identical elements or elements having identical functions are designated by the same reference symbols and will not be redundantly described. The description will be given in the following order.

1. Overall description of a connector device and a communication system according to the present disclosure
2. Communication system to which the technology according to the present disclosure is applied
2-1. Basic configuration of the communication system
2-2. Detailed configuration of a transmitter section and of a receiver section
3. Connector device according to the embodiment of the present disclosure
3-1. First working example (an example in which a magnet is included in only a peripheral device)
3-2. Second working example (a modification of the first working example)
3-3. Third working example (another modification of the first working example)
3-4. Fourth working example (still another modification of the first working example)
3-5. Fifth working example (an example in which a magnet is included in both an electronic device and the peripheral device)
3-6. Sixth working example (a power connector is integrally incorporated)
3-7. Seventh working example (a modification of the sixth working example)
3-8. Eighth working example (a modification of the seventh working example)
3-9. Ninth working example (an example in which a choke structure is included to suppress unwanted radiation)
3-10. Tenth working example (an example in which the positions of the magnet and a yoke are changed to increase attractive force)
3-11. Eleventh working example (a modification of the tenth working example)
3-12. Twelfth working example (an exemplary structure for permitting reverse insertion)
4. Modifications <Overall Description of a Connector Device and a Communication System According to the Present Disclosure>

A second connector section included in a connector device and in a communication system in accordance with the present disclosure may include a shield member formed of a rubber elastic body. The shield member is disposed between a yoke and a magnet and protruded from end faces of the yoke and the magnet. A waveguide of a first connector section may be covered with a shield material formed of a magnetic body.

In the connector device and communication system according to the present disclosure that include the above-described preferred configuration, the first connector section may be configured so that the periphery of the magnet is covered with a part of the yoke.

Further, in the connector device and communication system according to the present disclosure, the first connector section may be configured so that the periphery of the yoke is covered with the magnet, and that a shield member formed of a rubber elastic body is disposed between the yoke and the magnet. In this instance, the shield member may not be protruded from the end faces of the yoke and the magnet.

In the connector device and communication system according to the present disclosure that include the above-described preferred configuration, the first connector section and the second connector section may include a power supply terminal that supplies electrical power between the first connector section and the second connector section. Alternatively, the shield material of the first connector section and the yoke of the second connector section may be configured to double as a power supply terminal for supplying electrical power between the first connector section and the second connector section.

Further, in the connector device and communication system according to the present disclosure that include the above-described preferred configuration, the yoke of at least either the first connector section or the second connector section may have a choke structure that is built by forming an annular groove around the waveguide. In this instance, the depth of the groove in the choke structure is preferably set to ¼ the wavelength of the high-frequency signal.

In the connector device and communication system according to the present disclosure, the first connector section may include two waveguides, two yokes, an intermediate yoke, and a coupling yoke. The two yokes cover the two respective waveguides. The intermediate yoke is disposed between the two yokes. The coupling yoke magnetically couples the two yokes to the intermediate yoke. Further, the second connector section may include two waveguides, two yokes, and an attractive section. The two waveguides correspond to the two waveguides of the first connector section. The two yokes cover the two respective waveguides. The attractive section exerts an attractive force on the intermediate yoke of the first connector section. In this instance, the attractive section of the second connector section may include a magnet disposed between the two yokes and a yoke for magnetically coupling each of the two yokes to the magnet, or include a yoke.

Alternatively, in the connector device and communication system according to the present disclosure, the first connector section may include three waveguides, three yokes for covering the three respective waveguides, and a coupling yoke for magnetically coupling the three yokes, use an intermediate one of the three waveguides for reception or transmission purposes, and use a waveguide at either end for transmission or reception purposes. Further, the second connector section may include three waveguides corresponding to the three waveguides of the first connector section, three yokes for covering the three respective waveguides, and two magnets disposed between the three yokes. When the first connector section uses the intermediate waveguide for reception purposes, the second connector section may use the intermediate one of the three waveguides for transmission purposes and use the waveguides at both ends for reception purposes. Meanwhile, when the first connector section uses the intermediate waveguide for transmission purposes, the second connector section may use the intermediate one of the three waveguides for reception purposes and use the waveguides at both ends for transmission purposes. The remaining waveguide, which is disposed at either end of the first connector section, preferably has a termination structure. The termination structure is formed to block an end of the waveguide that is positioned opposite the other end to be coupled to the second connector section.

Moreover, in the connector device and communication system according to the present disclosure that include the above-described preferred configuration, a millimeter-wave band signal may be used as the high-frequency signal. When communication is established by using a millimeter-wave band signal as the high-frequency signal, that is, when millimeter-wave communication is established, the following advantages are obtained.

a) As millimeter-wave communication permits the use of a wide communication bandwidth, a high data rate can easily be achieved.

b) As a frequency used for transmission can be separated from a frequency for a different baseband signal process, frequency interference is unlikely to occur between a millimeter wave and a baseband signal.

c) As a millimeter-wave band uses a short wavelength, a coupling structure and a waveguide structure can be reduced in size because they depend on wavelength. In addition, electromagnetic shielding can easily be achieved due to significant distance attenuation and low diffraction.

d) In common wireless communication, stringent restrictions are imposed on carrier wave stability in order to prevent interference and other problems. Such highly stable carrier waves are provided by using, for example, highly stable external frequency reference parts, a multiplication circuit, and a phase-locked loop circuit (PLL). This results in an increased circuit scale. Meanwhile, millimeter-wave communication prevents millimeter waves from readily leaking to the outside, and thus permits the use of less stable carrier waves for transmission purposes. This will prevent an increase in circuit scale.

<Communication System to which the Technology According to the Present Disclosure is Applied>

Basic Configuration of the Communication System

FIG. 1 is a plan view including a partial cross-sectional view that illustrates a basic configuration of the communication system to which the technology according to the present disclosure is applied. A communication system 10 according to the present application example uses a high-speed transmission path to transmit (communicate) signals between two electronic devices (hereinafter referred to as the "communication devices") or, more specifically, between a first communication device 20 and a second communication device 30.

The first communication device 20 includes a transmitter section 22 and a waveguide 23. The transmitter section 22 and the waveguide 23 are disposed within a housing 21. Similarly, the second communication device 30 includes a receiver section 32 and a waveguide 33. The receiver section 32 and the waveguide 33 are disposed within a housing 31. The housing 21 for the first communication device 20 and the housing 31 for the second communication device 30 are, for example, rectangular in shape, and formed of a dielectric, such as resin having a dielectric constant of approximately 3 and a thickness of approximately 0.2 mm. That is to say, the housing 21 for the first communication device 20 and the housing 31 for the second communication device 30 are resin housings.

The communication system 10, which includes the first communication device 20 and the second communication device 30, establishes communication between the first communication device 20 and the second communication device 30 through a connector device 40 by using a high-frequency signal such as a millimeter-wave band signal. That is to say, the connector device 40 establishes electrical connection between the first communication device 20 and the second communication device 30. The connector device 40 includes a first connector section 24, which is for the first communication device 20, and a second connector section 34, which is for the second communication device 30.

In the first communication device 20, the waveguide 23 is disposed between an output end of the transmitter section 22 and the first connector section 24. The waveguide 23 forms a transmission path for conveying a millimeter-wave band signal transmitted from the transmitter section 22. Similarly, in the second communication device 30, the waveguide 33 is disposed between an input end of the receiver section 32 and the second connector section 34. The waveguide 33 forms a transmission path for conveying a millimeter-wave band signal to be received.

Typically, a hollow waveguide or a dielectric waveguide may be exemplified as the waveguide. Either a hollow waveguide or a dielectric waveguide may be used as the waveguide 23 for the first communication device 20 and as the waveguide 33 for the second communication device 30. However, it is assumed herein that a hollow waveguide, particularly, a rectangular waveguide having an oblong cross-section, is used. The proportion between the long side and short side of the cross-section of the rectangular waveguide is preferably 2 to 1. A 2-to-1 rectangular waveguide is advantageous in that it prevents the occurrence of a higher mode and achieves high transmission efficiency. However, the waveguides 23 and 33 are not limited to those having an oblong cross-section. The waveguides 23 and 33 having a square or circular cross-section may also be used.

In the first communication device 20, the transmitter section 22 performs a process of converting a transmission target signal to a millimeter-wave band signal and outputting the resulting millimeter-wave band signal to the waveguide 23. The waveguide 23 receives the millimeter-wave band signal outputted from the transmitter section 22 and conveys the millimeter-wave band signal to the second communication device 30 through the connector device 40. In the second communication device 30, the receiver section 32 performs a process of receiving the millimeter-wave band signal, which is conveyed from the first communication device 20 through the connector device 40 and the waveguide 33, and restoring the received millimeter-wave band signal to the original transmission target signal.

Detailed Configuration of a Transmitter Section and of a Receiver Section

Figure 2A:
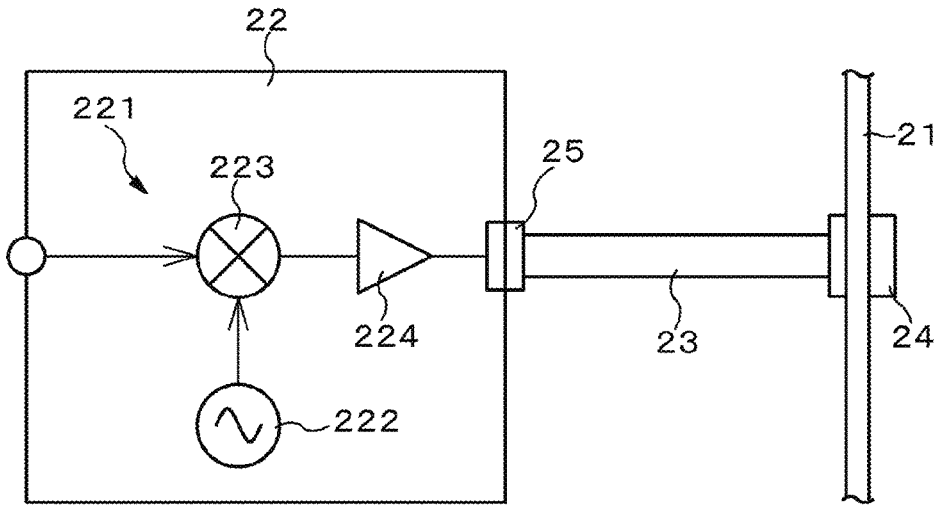
FIG. 2A is a block diagram illustrating an exemplary detailed configuration of a transmitter section.
Figure 2B:
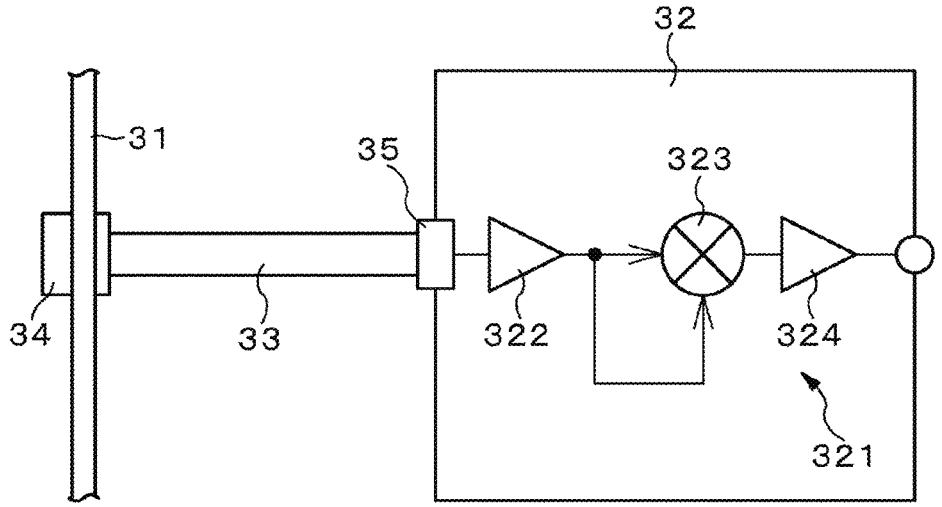
FIG. 2B is a block diagram illustrating an exemplary detailed configuration of a receiver section.

Detailed configurations of the transmitter section 22 and the receiver section 32 will now be described. FIG. 2A illustrates an exemplary detailed configuration of the transmitter section 22, and FIG. 2B illustrates an exemplary detailed configuration of the receiver section 32.

The transmitter section 22 includes, for example, a signal generation section 221 that processes a transmission target signal to generate a millimeter-wave band signal. The signal generation section 221 is a signal converter for converting the transmission target signal to a millimeter-wave band signal and formed, for example, of an amplitude shift keying (ASK) modulation circuit. More specifically, the signal generation section 221 multiplies a millimeter-wave band signal given from an oscillator 222 by the transmission target signal through the use of a multiplier 223 in order to generate a millimeter-wave band ASK modulated wave, and then outputs the generated millimeter-wave band ASK modulated wave through a buffer 224.

A connector device 25 is disposed between the transmitter section 22 and the waveguide 23. The connector device 25 couples the transmitter section 22 to the waveguide 23, for example, by means of capacitive coupling, electromagnetic induction coupling, electromagnetic field coupling, or resonator coupling. The waveguide 23 is disposed between the connector device 25 and the first connector section 24.

The receiver section 32 includes a signal restoration section 321 that restores the original transmission target signal by processing the millimeter-wave band signal given through the waveguide 33. The signal restoration section 321 is a signal converter for converting the received millimeter-wave band signal to the original transmission target signal and formed of a square law detector circuit. More specifically, the signal restoration section 321 squares the millimeter-wave band signal (ASK modulated wave), which is given through a buffer 322, by using a multiplier 323 in order to convert the millimeter-wave band signal to the original transmission target signal, and then outputs the resulting original transmission target signal through a buffer 324.

A connector device 35 is disposed between the waveguide 33 and the receiver section 32. The connector device 35 couples the waveguide 33 to the receiver section 32, for example, by means of capacitive coupling, electromagnetic induction coupling, electromagnetic field coupling, or resonator coupling. The waveguide 33 is disposed between the second connector section 34 and the connector device 35.

As described earlier, the communication system 10 according to the present application example establishes millimeter-wave communication between the first communication device 20 and the second communication device 30 through the connector device 40 by using a millimeter-wave band signal as the high-frequency signal. One example of this kind of communication system 10 may be configured so that the first communication device 20 is formed of an electronic device, such as a notebook computer, a tablet, a smartphone, or other mobile terminal, and that the second communication device 30 is formed of a peripheral device for the electronic device, such as a freestanding expanded device called a cradle. However, the system configuration exemplified above is merely an example, and the communication system 10 is not limited to such a system configuration.

<Connector Device According to the Embodiment of the Present Disclosure>

The present embodiment is made to implement the connector device 40 that is used in the communication system 10 having the above-described configuration, namely, the communication system 10 adapted to establish communication by using a high-frequency signal or preferably a millimeter-wave band signal, exhibits increased resistance to electrical breakdown, and is resistant to physical breakdown. As illustrated in FIGS. 3A, 3B and 3C and 4, the connector device 40 according to the present embodiment includes a first connector section 50 and a second connector section 60. The first connector section 50 corresponds to the first connector section 24 that is provided for the first communication device 20 as depicted in FIG. 1. The second connector section 60 corresponds to the second connector section 34 that is provided for the second communication device 30 as depicted in FIG. 1.

In the connector device 40 according to the present embodiment, the first connector section 50 and the second connector section 60 each include a waveguide for transmitting a millimeter-wave band signal as an example of a high-frequency signal (high-speed signal), and transmit the millimeter-wave band signal by means of electromagnetic field coupling and not by means of electrical current. Therefore, the transmission of the millimeter-wave band signal is not significantly affected even if the coupling portions between the first connector section 50 and the second connector section 60 of the connector device 40 are not in perfect contact with each other, that is, a gap exists between the two connector sections 50 and 60 or the joint between the two connector sections 50 and 60 is not reliable.

Particularly, the second connector section 60 includes a waveguide for transmitting a millimeter-wave band signal, a yoke disposed to cover the waveguide, and a magnet forming a magnetic circuit with the yoke, and is couplable to the first connector section 50 by the attractive force of the magnet. That is to say, a through-hole oriented in the direction of signal transmission is formed in the yoke and used as a waveguide for transmitting a millimeter-wave band signal.

In the connector device 40 according to the present embodiment, which is configured as described above, the second connector section 60 is couplable to the first connector section 50 by the attractive force of the magnet, and the coupling portion of the second connector section 60 does not include any insertion/removal portion that is susceptible to physical breakdown, namely, weak in physical strength. Further, the second connector section 60 has a coupling structure formed of the magnet and the yoke. This reduces the number of required parts. Thus, the connector device 40 can be downsized. Particularly, the waveguide size (yoke size) can be reduced by using a millimeter-wave band signal or other signal having a high frequency as the high-frequency signal (high-speed signal). Therefore, the connector device 40 can be further downsized.

Moreover, as the coupling structure formed of the magnet and the yoke is employed, the second connector section 60 can easily be attached to and detached from the first connector section 50, and the first connector section 50 and the second connector section 60 can be properly coupled to each other. Thus, the connector device 40 according to the present embodiment not only provides increased resistance to electrical breakdown but also provides increased resistance to physical breakdown. Additionally, as a magnetic flux passes through the waveguides, positioning can be properly achieved between the waveguides of the first connector section 50 and the second connector section 60, or positional deviation between the waveguides of the first connector section 50 and the second connector section 60 can be minimized. Incidentally, a structure in which a waveguide is separate from a magnet causes a greater positional deviation (displacement) than an integral structure.

Specific working examples of the connector device 40 according to the present embodiment, that is, the first connector section 50 provided for the first communication device 20 and the second connector section 60 provided for the second communication device 30, will now be described in detail. The specific working examples described below assume that the first connector section 50 and the second connector section 60 each include two waveguides in order to establish two-way communication.

Further, the specific working examples are described below on the assumption that the first connector section 50 is a connector section provided for an electronic device such as a notebook computer, a tablet, or a smartphone, and that the second connector section 60 is a connector section provided for a peripheral device such as a cradle.

First Working Example

Figure 3A:
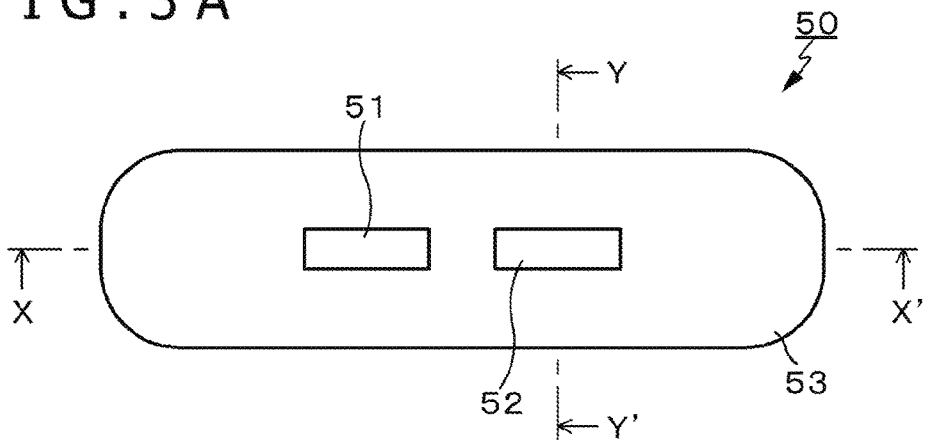
FIG. 3A is a top view illustrating a first connector section according to a first working example.
Figure 3B:
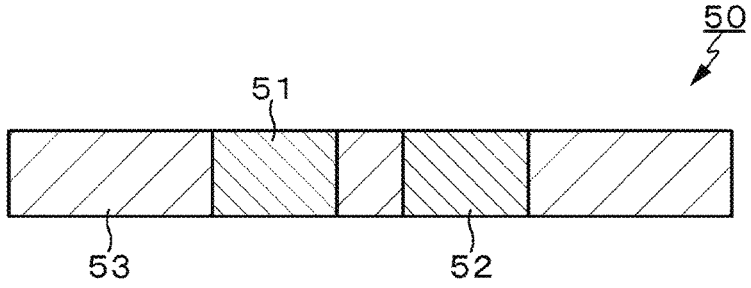
FIG. 3B is a cross-sectional view taken along line X-X' of FIG. 3A.
Figure 3C:
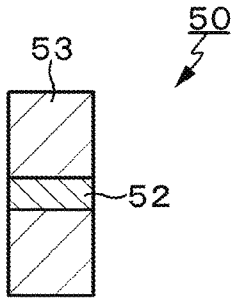
FIG. 3C is a cross-sectional view taken along line Y-Y' of FIG. 3A.

FIG. 3A is a top view illustrating the first connector section 50 according to a first working example. FIG. 3B is a cross-sectional view taken along line X-X' of FIG. 3A. FIG. 3C is a cross-sectional view taken along line Y-Y' of FIG. 3A.

The first connector section 50 includes, for example, two millimeter-wave waveguides 51 and 52. The millimeter-wave waveguides 51 and 52 are formed, for example, of a dielectric. The two millimeter-wave waveguides 51 and 52 are covered with a millimeter-wave shield material 53 that is formed of a magnetic body, such as 400 series (chromium-based) stainless steel. Thus, the millimeter-wave shield material 53 is structured integrally with a dielectric waveguide that includes the millimeter-wave waveguides 51 and 52. The 400 series stainless steel is ferromagnetic.

Figure 4A:
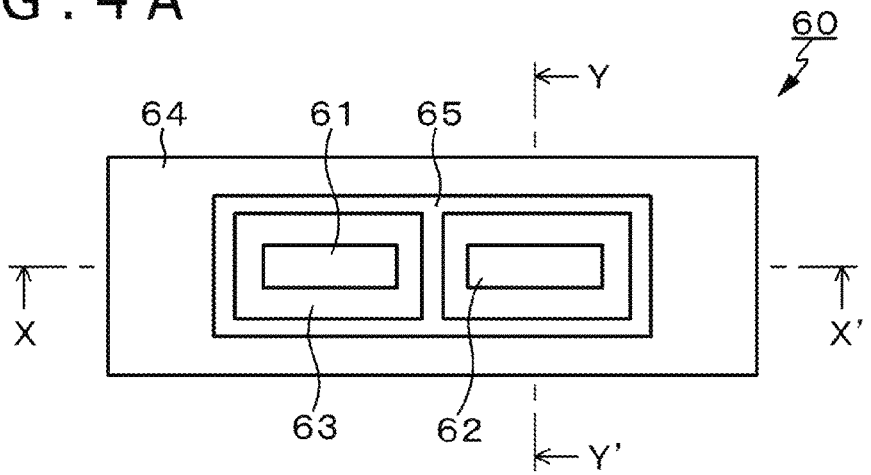
FIG. 4A is a top view illustrating a second connector section according to the first working example.
Figure 4B:
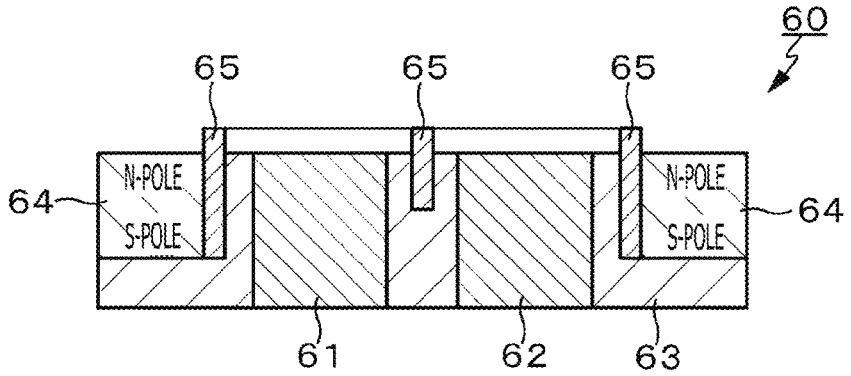
FIG. 4B is a cross-sectional view taken along line X-X' of FIG. 4A.
Figure 4C:
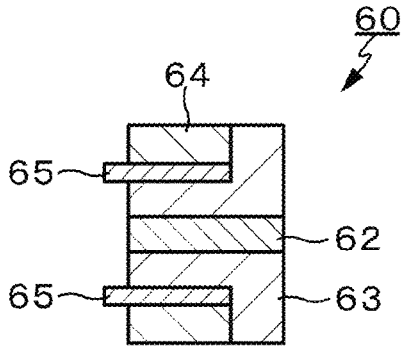
FIG. 4C is a cross-sectional view taken along line Y-Y' of FIG. 4A.

FIG. 4A is a top view illustrating the second connector section 60 according to the first working example. FIG. 4B is a cross-sectional view taken along line X-X' of FIG. 4A. FIG. 4C is a cross-sectional view taken along line Y-Y' of FIG. 4A.

The second connector section 60 includes two millimeter-wave waveguides 61 and 62 that correspond to the millimeter-wave waveguides 51 and 52 of the first connector section 50. The millimeter-wave waveguides 61 and 62 are covered, for example, with a flange-shaped yoke 63 formed of a magnetic body such as 400 series stainless steel. Thus, the yoke 63 is structured integrally with a dielectric waveguide that includes the millimeter-wave waveguides 61 and 62. The yoke 63 doubles as a millimeter-wave shield material. A magnet 64 having, for example, a rectangular annular shape is disposed on the flange portion of the yoke 63. For example, the magnet 64 may be an anisotropic magnet that provides strong magnetization only in a particular direction.

In the present working example, the magnet 64 is configured so that S- and N-poles are vertically arrayed in the direction in which the millimeter-wave waveguides 61 and 62 transmit a millimeter-wave band signal. Thus, the magnet 64 and the yoke 63 form a magnetic circuit that serves as a path of magnetic flux, namely, a bundle of magnetic field lines. However, the magnet 64 is not limited to the vertical array of S- and N-poles. Alternatively, the S- and N-poles may be horizontally arrayed inside and outside a rectangular ring. In short, the S- and N-poles should be arrayed in such a manner that the magnet 64 and the yoke 63 form a magnetic circuit.

A shield member 65 formed of rubber elastic body, such as a carbon-based conductive rubber material, is disposed between the yoke 63 and the magnet 64 so as to enclose the yoke 63. As depicted in FIGS. 4B and 4C, a part of the shield member 65 is protruded from end faces of the yoke 63 and the magnet 64. The shield member 65 not only functions as a shield material for preventing the millimeter-wave band signal from leaking to the outside, but also avoids a short circuit between the S- and N-poles of the magnet 64.

In the connector device 40 according to the first working example, which includes the first connector section 50 and second connector section 60 having the above-described configuration, the second connector section 60 is coupled to the first connector section 50 by the attractive force of the magnet 64, which forms a magnetic circuit with the yoke 63. The second connector section 60 of the connector device 40 according to the first working example is structured so that the magnetic circuit is integral with the shield material (yoke 63), that is, a guide for the millimeter-wave waveguides 61 and 62. Therefore, the connector device 40 does not include any insertion/removal portion and is unsusceptible to physical breakdown. Further, the connector device 40 can be downsized and thinned because the coupling portions are without an insertion/removal portion susceptible to physical breakdown.

Figure 5A:
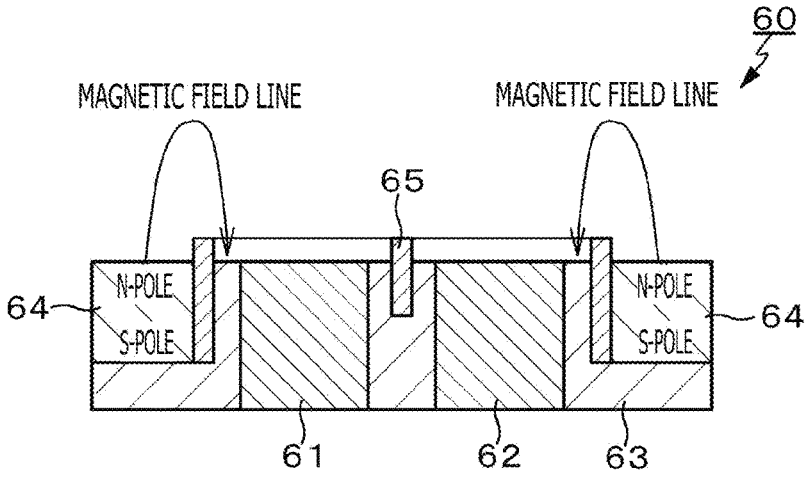
FIG. 5A is a diagram illustrating how magnetic field lines concentrate on a coupling portion of the second connector section that is to be coupled to the first connector section.

Moreover, in the second connector section 60 of the connector device 40 according to the first working example, the magnetic field lines of the magnet 64 can be concentrated on a coupling surface (contact surface) that is to be coupled to the first connector section 50, as depicted in FIG. 5A.

Therefore, the attractive force of the yoke 63, which is based on the magnetic field lines of the magnet 64, can be increased. This compensates for a disadvantage caused by downsizing and thinning of the connector device 40, namely, a decrease in the attractive force that is caused by a decrease in the area of a magnetic field line generation plane. That is to say, even if the area of the magnetic field line generation plane is decreased due to the downsizing and thinning of the connector device 40 and the attractive force is decreased accordingly, the above-described structure provides a sufficient attractive force for coupling the second connector section 60 to the first connector section 50.

Figure 5B:
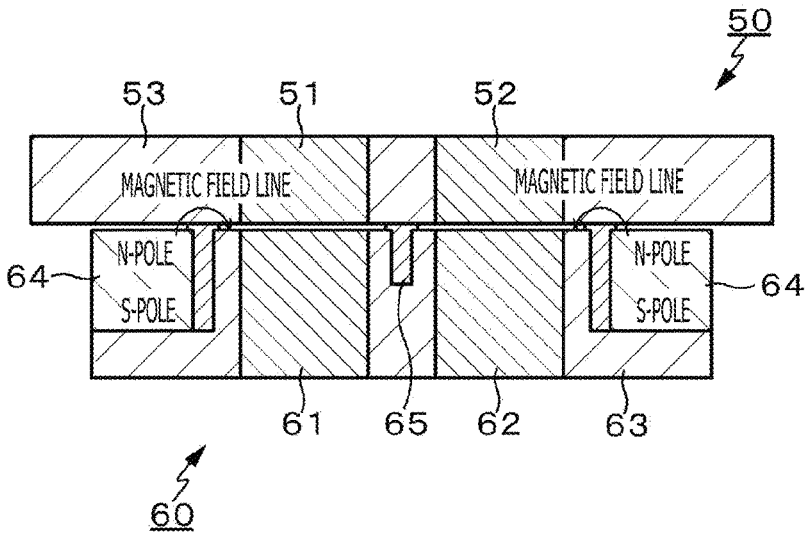
FIG. 5B is a cross-sectional view illustrating the second connector section that is coupled to the first connector section.

Additionally, when the second connector section 60 is coupled to the first connector section 50, the protrusion of the shield member 65 collapses as depicted in FIG. 5B to shorten its distance to the millimeter-wave shield material 53 of the first connector section 50 and fill the gap to the millimeter-wave shield material 53. This not only strengthens the magnetic field lines at the coupling portions to increase the attractive force of the yoke 63 based on the magnetic field lines of the magnet 64, but also prevents leakage of radio waves between the millimeter-wave waveguides 51 and 52 of the first connector section 50 and the millimeter-wave waveguides 61 and 62 of the second connector section 60.

When the connector device 40 according to the first working example establishes data communication over a millimeter-wave band, the bandwidth per channel is, for example, approximately 5 Gbps in a 40-nm process. However, the bandwidth can be further increased in a subsequent process generation. Moreover, as the connector device 40 according to the first working example is structured so as to prevent the leakage of radio waves between the first connector section 50 and the second connector section 60, the bandwidth may be increased when a plurality of waveguides are provided by repeating the same structure as the above-described connector structure. Additionally, full-duplex two-way communication can be established by individually allocating the transmitting end and the receiving end to one of the waveguides.

Second Working Example

Figure 6:
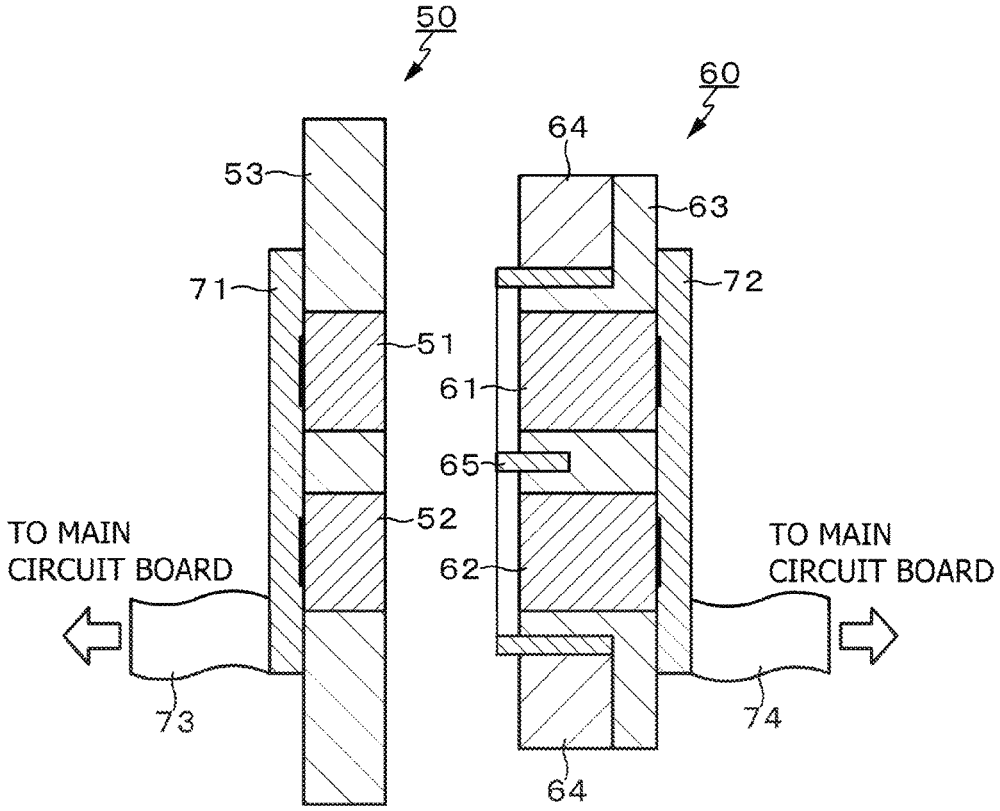
FIG. 6 is a cross-sectional view illustrating the first connector section and the second connector section that are uncoupled within a connector device according to a second working example.

A second working example is a modification of the first working example. FIG. 6 is a cross-sectional view illustrating the first connector section 50 and the second connector section 60 that are uncoupled within the connector device 40 according to the second working example.

As illustrated in FIG. 6, the connector device 40 according to the second working example is configured so that the first connector section 50 is directly attached to a transmitting-end millimeter-wave module 71, and that the second connector section 60 is directly attached to a receiving-end millimeter-wave module 72. The transmitting-end millimeter-wave module 71 includes the transmitter section 22 depicted in FIG. 2A, and is electrically connected to a main circuit board (not depicted), for example, through a flexible cable 73. The receiving-end millimeter-wave module 72 includes the receiver section 32 depicted in FIG. 2B, and is electrically connected to a main circuit board (not depicted), for example, through a flexible cable 74.

Third Working Example

Figure 7:
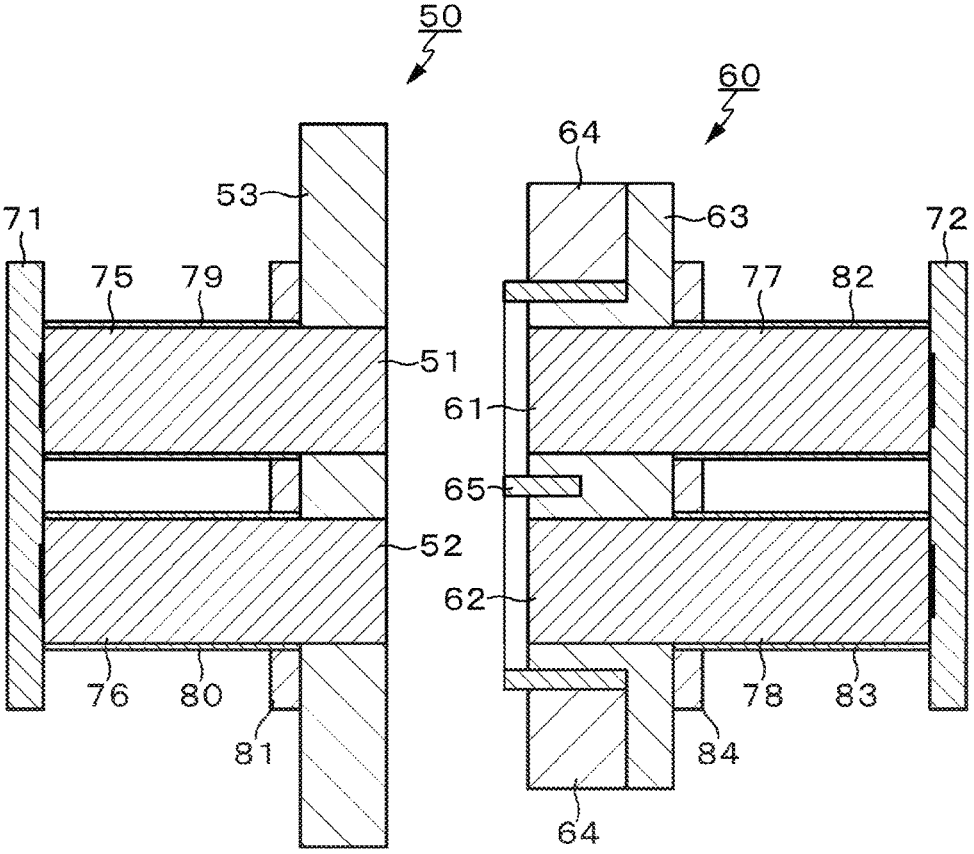
FIG. 7 is a cross-sectional view illustrating the first connector section and the second connector section that are uncoupled within the connector device according to a third working example.

A third working example is another modification of the first working example. FIG. 7 is a cross-sectional view illustrating the first connector section 50 and the second connector section 60 that are uncoupled within the connector device 40 according to the third working example.

As illustrated in FIG. 7, the connector device 40 according to the third working example is configured so that the first connector section 50 is connected to the transmitting-end millimeter-wave module 71 through waveguides 75 and 76, and that the second connector section 60 is connected to the receiving-end millimeter-wave module 72 through waveguides 77 and 78. The third working example is configured so that the transmitting-end millimeter-wave module 71 and the receiving-end millimeter-wave module 72 are mounted on the respective main circuit boards (not depicted).

The waveguides 75 and 76 are shielded waveguides covered with shield members 79 and 80 and integral with the waveguides 51 and 52 of the first connector section 50. A conductive plastic member 81 is disposed at the joint between the shielded waveguides 75 and 76 and the first connector section 50. The waveguides 77 and 78 are shielded waveguides covered with shield members 82 and 83 and integral with the waveguides 61 and 62 of the second connector section 60. A conductive plastic member 84 is disposed at the joint between the shielded waveguides 77 and 78 and the second connector section 60.

Fourth Working Example

A fourth working example is a still another modification of the first working example, and is structured to exhibit a stronger attractive force than the first working example.

Figure 8A:
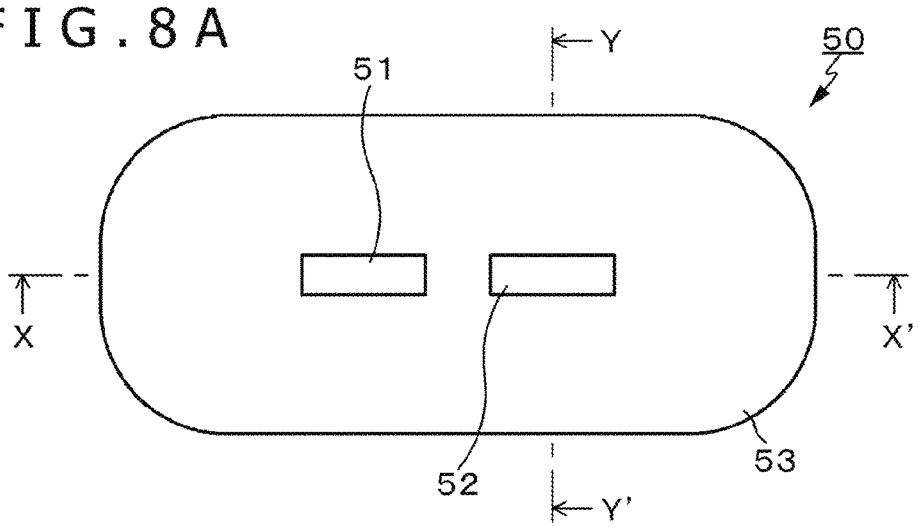
FIG. 8A is a top view illustrating the first connector section according to a fourth working example.
Figure 8B:
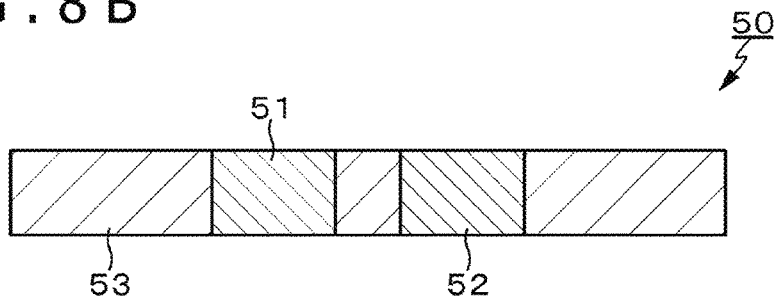
FIG. 8B is a cross-sectional view taken along line X-X' of FIG. 8A.
Figure 8C:
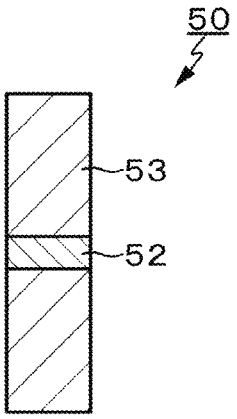
FIG. 8C is a cross-sectional view taken along line Y-Y' of FIG. 8A.

FIG. 8A is a top view illustrating the first connector section 50 according to the fourth working example. FIG. 8B is a cross-sectional view taken along line X-X' of FIG. 8A. FIG. 8C is a cross-sectional view taken along line Y-Y' of FIG. 8A.

The first connector section 50 according to the fourth working example has basically the same configuration as the first connector section 50 according to the first working example. That is to say, the first connector section 50 according to the fourth working example includes two millimeter-wave waveguides 51 and 52 formed, for example, of a dielectric, and the millimeter-wave waveguides 51 and 52 are covered with a millimeter-wave shield material 53 that is formed of a magnetic body, such as 400 series stainless steel. The only difference between the first connector section 50 according to the fourth working example and the first connector section 50 according to the first working example is that the millimeter-wave shield material 53 according to the fourth working example, which covers the millimeter-wave waveguides 51 and 52, has a larger surface area than in the case of the first working example.

Figure 9A:
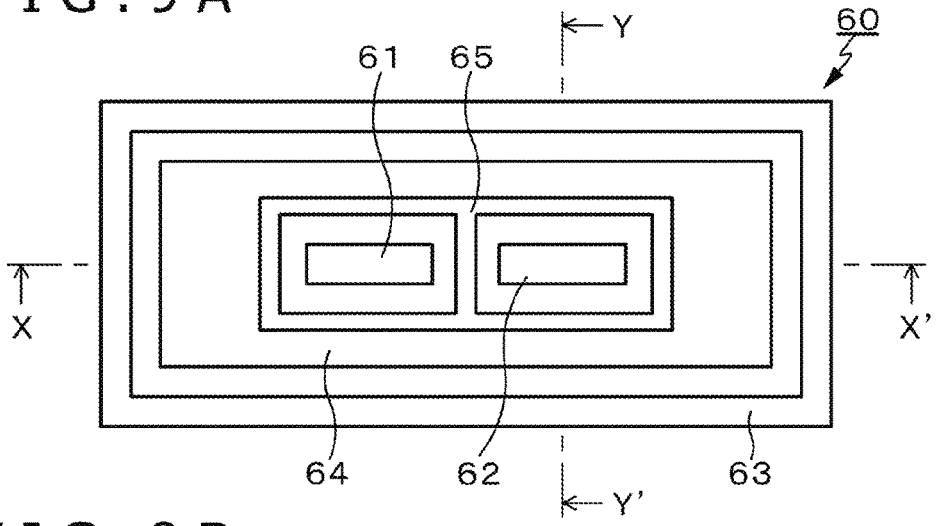
FIG. 9A is a top view illustrating the second connector section according to the fourth working example.
Figure 9B:
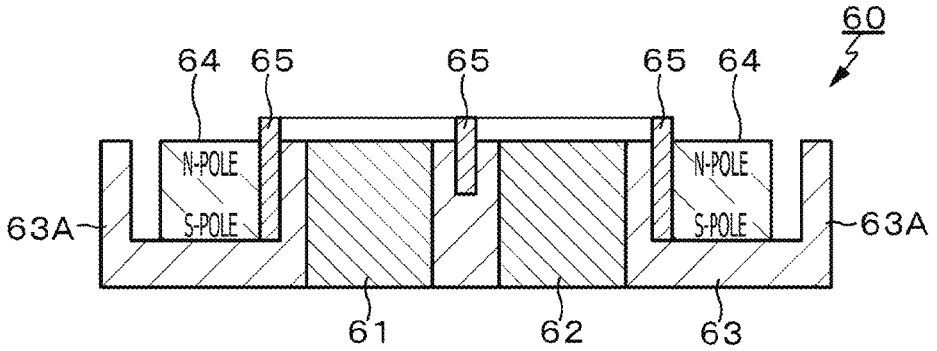
FIG. 9B is a cross-sectional view taken along line X-X' of FIG. 9A.
Figure 9C:
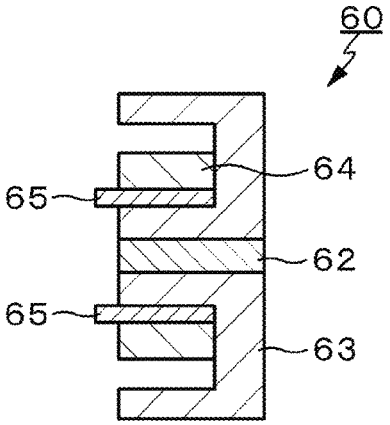
FIG. 9C is a cross-sectional view taken along line Y-Y' of FIG. 9A.

FIG. 9A is a top view illustrating the second connector section 60 according to the fourth working example. FIG. 9B is a cross-sectional view taken along line X-X' of FIG. 9A. FIG. 9C is a cross-sectional view taken along line Y-Y' of FIG. 9A.

The second connector section 60 according to the fourth working example has basically the same configuration as the second connector section 60 according to the first working example. That is to say, the second connector section 60 according to the fourth working example includes two millimeter-wave waveguides 61 and 62 corresponding to the millimeter-wave waveguides 51 and 52 of the first connector section 50, and the millimeter-wave waveguides 61 and 62 are covered, for example, with a flange-shaped yoke 63 formed of a magnetic body such as 400 series stainless steel.

A magnet 64 having, for example, a rectangular annular shape is disposed on the flange portion of the yoke 63. Additionally, a shield member 65 formed of a rubber elastic body, such as a carbon-based conductive rubber material, is disposed between the yoke 63 and the magnet 64 so as to enclose the yoke 63 while a part of the shield member 65 is protruded from the end faces of the yoke 63 and the magnet 64.

The second connector section 60 according to the fourth working example differs from the second connector section 60 according to the first working example in the structure of the yoke 63. More specifically, in the second connector section 60 according to the fourth working example, the yoke 63 has such a yoke structure that the flange portion of the yoke 63 is extended outward from the magnet 64, and that the outermost peripheral portion of the yoke 63 is raised to let a part 63A of the yoke 63 cover the outer periphery of the magnet 64. As the employed yoke structure causes the part (outer peripheral portion) 63A of the yoke 63 to cover the outer periphery of the magnet 64, the attractive force of the second connector section 60 for attracting the first connector section 50 is further increased as compared with the first working example, which does not have the yoke structure for causing the part 63A of the yoke 63 to cover the outer periphery of the magnet 64.

Fifth Working Example

Although the connector device 40 according to the first working example is configured so that a magnet is included only in the connector section (second connector section 60) for the peripheral device, the connector device 40 according to a fifth working example is configured so that a magnet is included in each of the connector sections for the electronic device and the peripheral device.

Figure 10A:
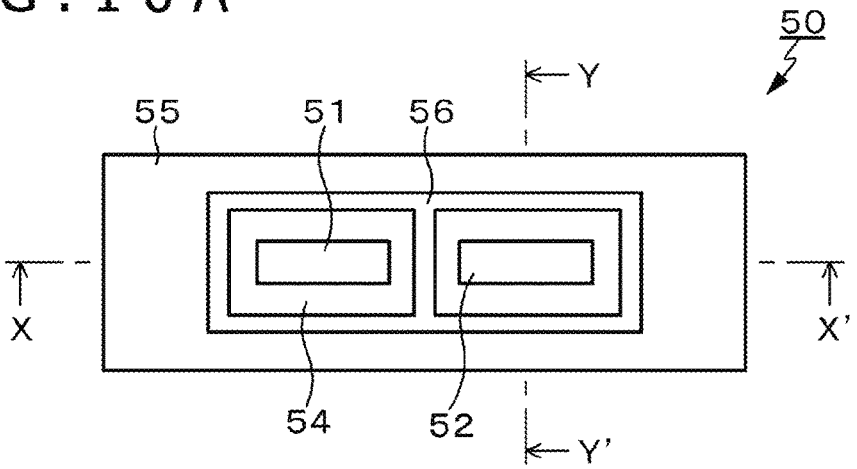
FIG. 10A is a top view illustrating the first connector section according to a fifth working example.
Figure 10B:
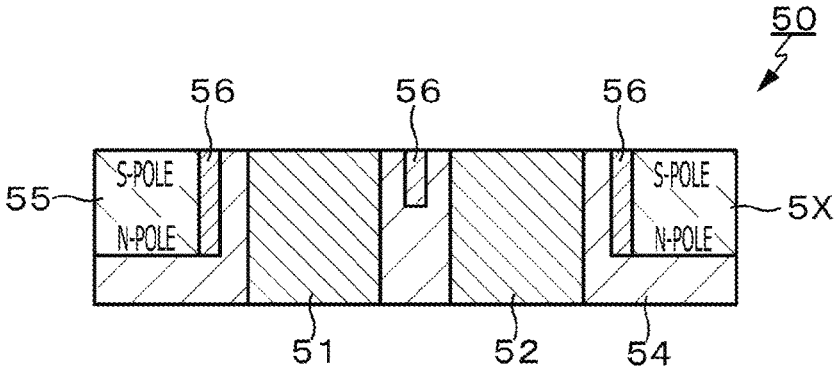
FIG. 10B is a cross-sectional view taken along line X-X' of FIG. 10A.
Figure 10C:
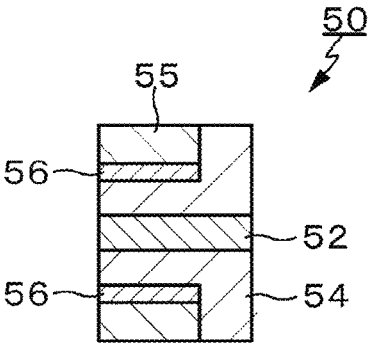
FIG. 10C is a cross-sectional view taken along line Y-Y' of FIG. 10A.

FIG. 10A is a top view illustrating the first connector section 50 according to the fifth working example. FIG. 10B is a cross-sectional view taken along line X-X' of FIG. 10A. FIG. 10C is a cross-sectional view taken along line Y-Y' of FIG. 10A.

The first connector section 50 according to the fifth working example has basically the same configuration as the second connector section 60 according to the first working example. That is to say, the first connector section 50 according to the fifth working example includes two millimeter-wave waveguides 51 and 52, and the millimeter-wave waveguides 51 and 52 are covered, for example, with a flange-shaped yoke 54 formed of a magnetic body such as 400 series stainless steel. An anisotropic magnet 55 having, for example, a rectangular annular shape is disposed on the flange portion of the yoke 54.

Additionally, a shield member 56 formed of a rubber elastic body, such as a carbon-based conductive rubber material, is disposed between the yoke 54 and the magnet 55 so as to enclose the yoke 54. The only difference between the first connector section 50 according to the fifth working example and the second connector section 60 according to the first working example is that the shield member 56 is not protruded from end faces of the yoke 54 and the magnet 55, namely, nothing is protruded from the end faces of the yoke 54 and the magnet 55. As the shield member 56 is not protruded from the end faces of the yoke 54 and the magnet 55 as described above, when the first connector section 50 and the second connector section 60 are coupled to each other, the distance between these connector sections 50 and 60 is shorter than when there is a protrusion from the end faces of the yoke 54 and the magnet 55.

Figure 11A:
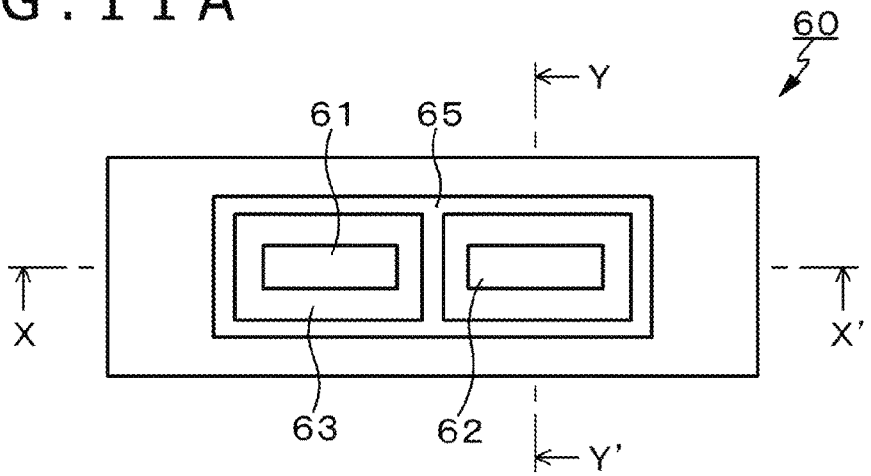
FIG. 11A is a top view illustrating the second connector section according to the fifth working example.
Figure 11B:
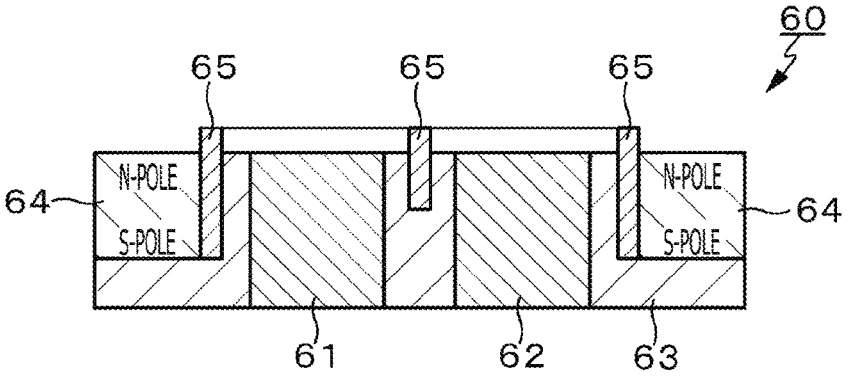
FIG. 11B is a cross-sectional view taken along line X-X' of FIG. 11A.
Figure 11C:
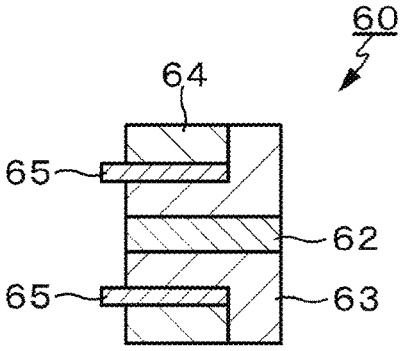
FIG. 11C is a cross-sectional view taken along line Y-Y' of FIG. 11A.

FIG. 11A is a top view illustrating the second connector section 60 according to the fifth working example. FIG. 11B is a cross-sectional view taken along line X-X' of FIG. 11A. FIG. 11C is a cross-sectional view taken along line Y-Y' of FIG. 11A.

The second connector section 60 according to the fifth working example has the same configuration as the second connector section 60 according to the first working example. That is to say, the second connector section 60 according to the fifth working example includes two millimeter-wave waveguides 61 and 62 corresponding to the millimeter-wave waveguides 51 and 52 of the first connector section 50, and the millimeter-wave waveguides 61 and 62 are covered, for example, with a flange-shaped yoke 63 formed of a magnetic body such as 400 series stainless steel. A magnet 64 having, for example, a rectangular annular shape is disposed on the flange portion of the yoke 63. Additionally, a shield member 65 formed of a rubber elastic body, such as a carbon-based conductive rubber material, is disposed between the yoke 63 and the magnet 64 so as to enclose the yoke 63 while a part of the shield member 65 is protruded from end faces of the yoke 63 and the magnet 64.

In the connector device 40 according to the fifth working example, which includes the above-configured first connector section 50 and second connector section 60, the magnet 55 for the first connector section 50 and the magnet 64 for the second connector section 60 are obviously disposed so that different magnetic poles face each other. This ensures that the attractive force exerted between the first connector section 50 and the second connector section 60 is stronger than when the magnet 64 is combined with the shield material 53 according to the first working example.

In the present working example, the protrusion of the shield member 56 for the first connector section 50 is eliminated to shorten the distance between the first connector section 50 and the second connector section 60 when they are coupled to each other. Alternatively, however, the protrusion of the shield member 65 for the second connector section 60 may be eliminated. Further, the shield structure according to the fourth working example, that is, the shield structure for causing a part of the yoke 63 to cover the outer periphery of the magnet 64, may be applied to the present working example.

Sixth Working Example

The connector device 40 according to a sixth working example is configured based, for example, on the configuration of the first connector section 50 and the second connector section 60 according to the first working example, and includes an integral power supply connector.

Figure 12A:
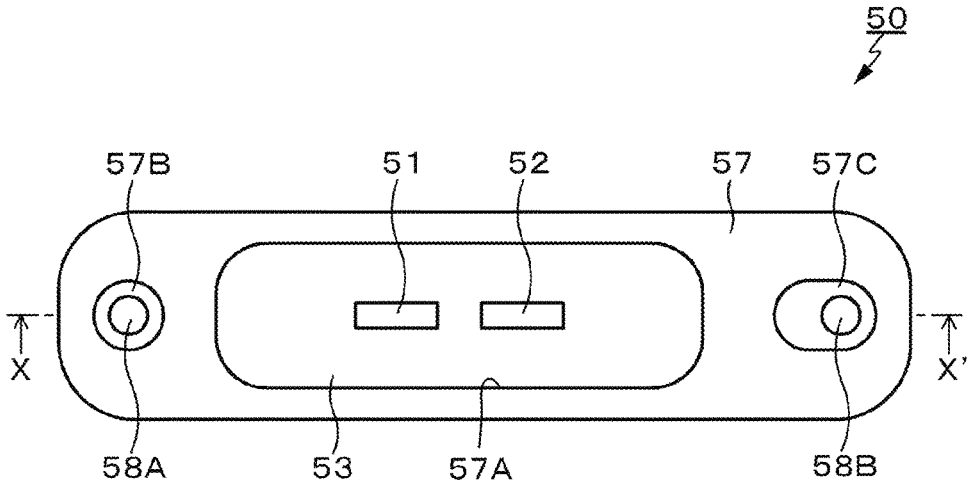
FIG. 12A is a top view illustrating the first connector section according to a sixth working example.
Figure 12B:
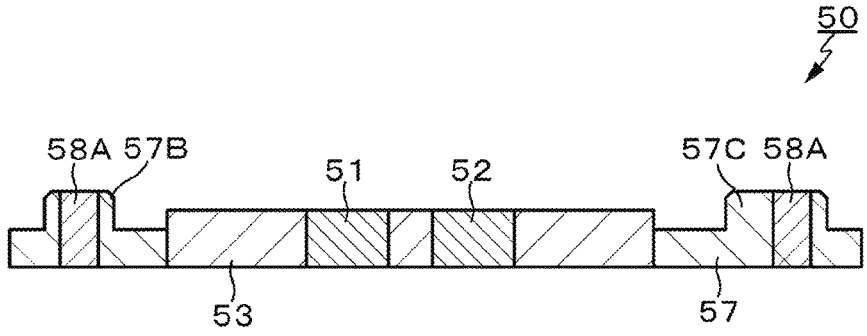
FIG. 12B is a cross-sectional view taken along line X-X' of FIG. 12A.

FIG. 12A is a top view illustrating the first connector section 50 according to the sixth working example. FIG. 12B is a cross-sectional view taken along line X-X' of FIG. 12A. The first connector section 50 according to the sixth working example is configured so that elements of the first connector section 50 according to the first working example, which is the base of the first connector section 50 according to the sixth working example, namely, the two millimeter-wave waveguides 51 and 52 and the millimeter-wave shield material 53 covering the two millimeter-wave waveguides 51 and 52, are fitted into a through-hole 57A at the center of a base substance 57 formed of plastic or other insulating material. Power supply terminals (e.g., jacks) 58A and 58B for supplying electrical power between the first connector section 50 and the second connector section 60 are disposed in projecting portions 57B and 57C at opposing longitudinal ends of the base substance 57.

Figure 13A:
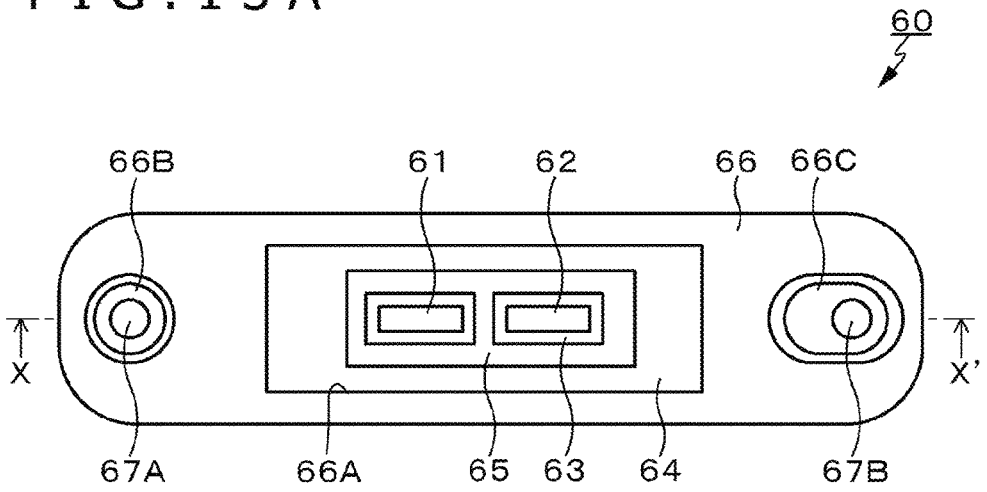
FIG. 13A is a top view illustrating the second connector section according to the sixth working example.
Figure 13B:
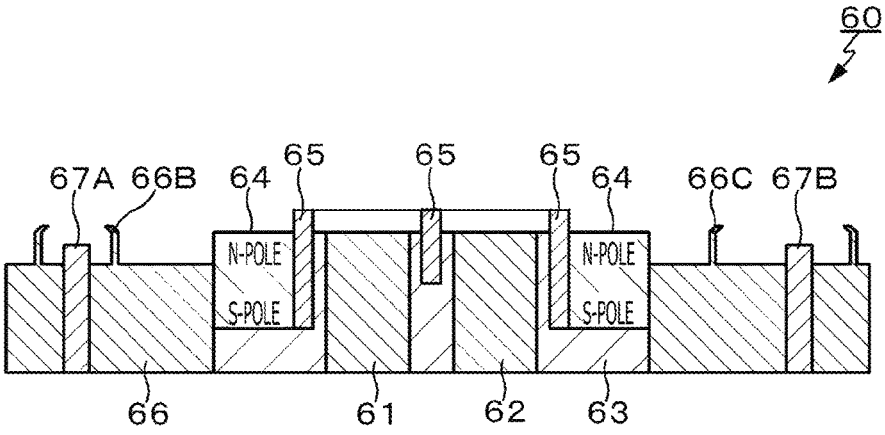
FIG. 13B is a cross-sectional view taken along line X-X' of FIG. 13A.

FIG. 13A is a top view illustrating the second connector section 60 according to the sixth working example. FIG. 13B is a cross-sectional view taken along line X-X' of FIG. 13A. The second connector section 60 according to the sixth working example is configured so that elements of the second connector section 60 according to the first working example, which is the base of the second connector section 60 according to the sixth working example, namely, the elements such as the two millimeter-wave waveguides 61 and 62, the yoke 63, and the magnet 64, are fitted into a through-hole 66A at the center of a base substance 66 formed of plastic or other insulating material. Power supply terminals (e.g., plugs) 67A and 67B for supplying electrical power between the first connector section 50 and the second connector section 60 are disposed at opposing longitudinal ends of the base substance 66. Additionally, annular mounting parts 66B and 66C, which are elastically detachable from the projecting portions 57B and 57C of the base substance 57 in the first connector section 50, are disposed around the power supply terminals 67A and 67B.

In the connector device 40 according to the sixth working example, which includes the above-configured first connector section 50 and second connector section 60, a power supply connector is formed of the power supply terminals 58A and 58B for the first connector section 50 and the power supply terminals 67A and 67B for the second connector section 60. When the attractive force of the magnet 64 couples the second connector section 60 to the first connector section 50, the power supply terminals 58A and 58B mate with the power supply terminals 67A and 67B so that electrical power can be supplied between the first connector section 50 and the second connector section 60.

The present working example has been described on the assumption that it is based on the configuration of the first connector section 50 and the second connector section 60 according to the first working example. Alternatively, however, the present working example may be based on the configuration of the first connector section 50 and the second connector section 60 according to the second, third, forth, or fifth working example. That is to say, the technology according to the present working example can be applied to the connector device 40 according to the second, third, fourth, or fifth working example.

Seventh Working Example

A seventh working example is a modification of the sixth working example. In the first to sixth working examples, the magnetic poles of the magnet 64, namely, the S- and N-poles, are arrayed in the signal transmission direction of the millimeter-wave waveguides 61 and 62 (in the direction in which a millimeter-wave band signal is transmitted). Meanwhile, the seventh working example is configured so that the S- and N-poles of the magnet 64 are arrayed in a direction orthogonal to the signal transmission direction.

Figure 14:
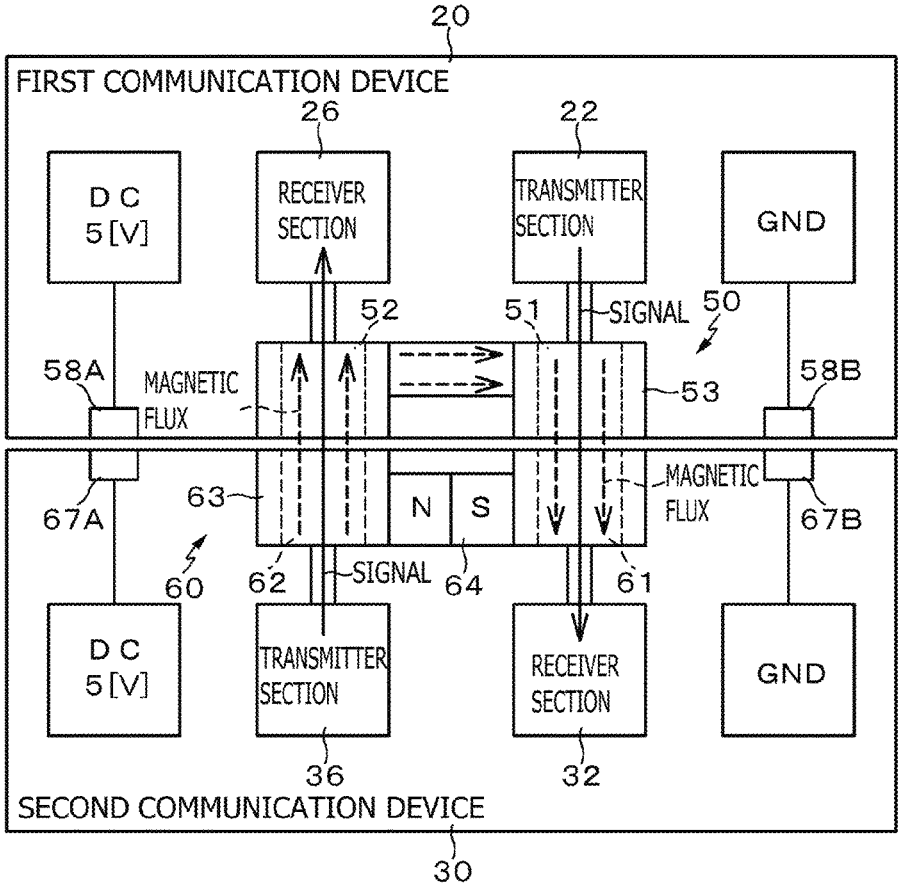
FIG. 14 is a schematic diagram illustrating a configuration of the connector device according to a seventh working example.

FIG. 14 is a schematic diagram illustrating a configuration of the connector device 40 according to the seventh working example. In the present working example, which is configured to establish two-way communication, the first communication device 20 includes a receiver section 26 in addition to the transmitter section 22, and the second communication device 30 includes a transmitter section 36 in addition to the receiver section 32. The receiver section 26 of the first communication device 20 may have the same configuration as the receiver section 32 of the second communication device 30. The transmitter section 36 of the second communication device 30 may have the same configuration as the transmitter section 22 of the first communication device 20.

Even when the magnetic poles of the magnet 64, namely, the S- and N-poles, are arrayed in the direction orthogonal to the direction in which a millimeter-wave band signal is transmitted, a magnetic circuit can be formed so that a magnetic flux passes through the waveguides 51 and 52 and the waveguides 61 and 62. As the magnetic flux passes through the waveguides 51 and 52 and the waveguides 61 and 62 as mentioned above, proper positioning can be achieved between the waveguides 51 and 52 of the first connector section 50 and the waveguides 61 and 62 of the second connector section 60. More specifically, positional deviation between the waveguides 51 and 52 of the first connector section 50 and the waveguides 61 and 62 of the second connector section 60 can be minimized. This also applies to the first to sixth working examples.

Between the first communication device 20 and the second communication device 30 according to the present working example, a millimeter-wave band signal is conveyed from the transmitter section 22 to the receiver section 32 through the waveguide 51 and the waveguide 61, and a millimeter-wave band signal is conveyed from the transmitter section 36 to the receiver section 26 through the waveguide 62 and the waveguide 52. That is to say, two-way communication is established between the first communication device 20 and the second communication device 30. Additionally, a power of 5 VDC, for example, is transmitted between the power supply terminal 58A for the first connector section 50 and the power supply terminal 67A for the second connector section 60, and a ground potential (GND) is applied between the power supply terminal 58B and the power supply terminal 67B.

Eighth Working Example

An eighth working example is a modification of the seventh working example. The millimeter-wave shield material 53 and the yoke 63, which double as waveguides, are capable of not only conveying a millimeter-wave band signal through the waveguides 51 and 52 and the waveguides 61 and 62, but also passing a DC current. The eighth working example is made while paying attention to this point.

Figure 15:
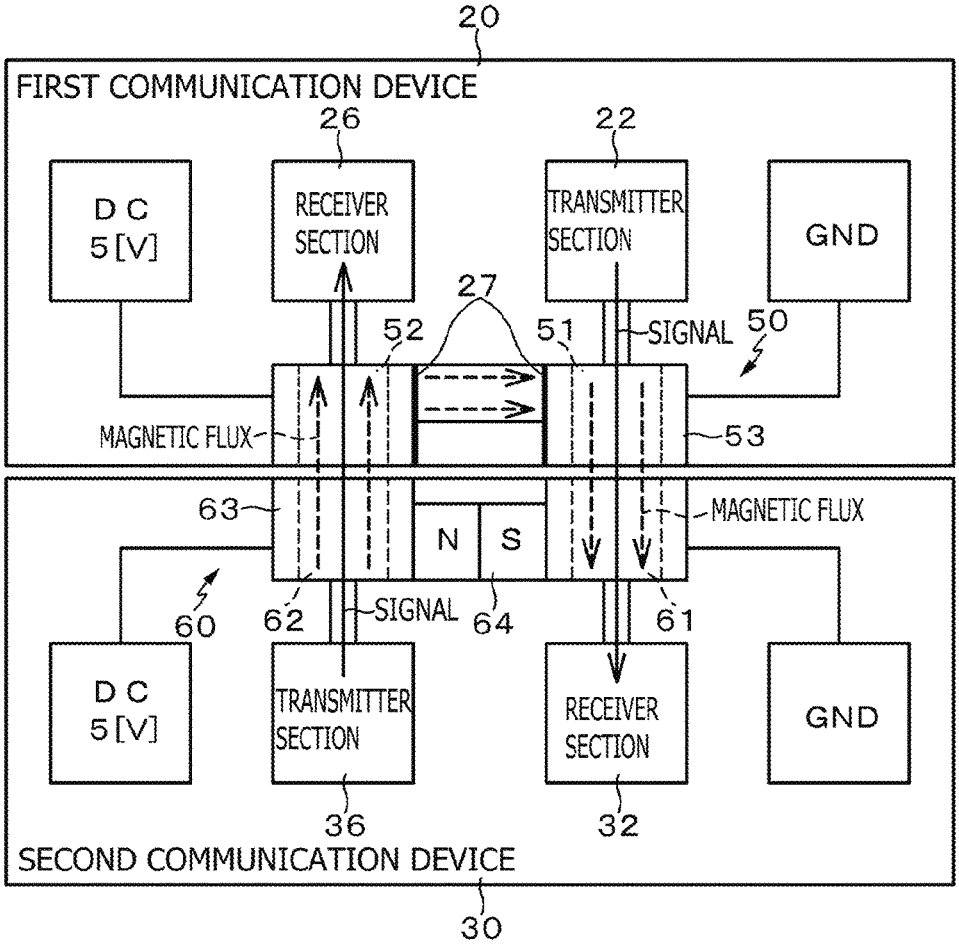
FIG. 15 is a schematic diagram illustrating a configuration of the connector device according to an eighth working example.

FIG. 15 is a schematic diagram illustrating a configuration of the connector device 40 according to the eighth working example. As depicted in FIG. 15, the connector device 40 according to the eighth working example is configured to permit the millimeter-wave shield material 53 and the yoke 63 to double as power supply terminals. Therefore, the power supply terminals 58A and 58B and the power supply terminals 67A and 67B used in the seventh working example can be omitted. Consequently, the connector device 40 can be reduced to a smaller size than in the case of the seventh working example. However, when the millimeter-wave shield material 53 and the yoke 63 double as power supply terminals, it is necessary that an insulating material 27 be provided for the millimeter-wave shield material 53 in the first communication device 20 in order to electrically insulate the waveguide 51 from the waveguide 52.

As described above, the millimeter-wave shield material 53 and the yoke 63, which double as waveguides, are capable of not only conveying a millimeter-wave band signal, which is a high-speed signal, but also passing a DC current. Therefore, allowing the millimeter-wave shield material 53 and the yoke 63 to double as power supply terminals and superimposing a power supply voltage (5 VDC in the present example) eliminates the necessity of a dedicated power supply terminal. This makes it possible to downsize the connector device 40 and reduce the number of parts required for the connector device 40.

Ninth Working Example

Figure 16:
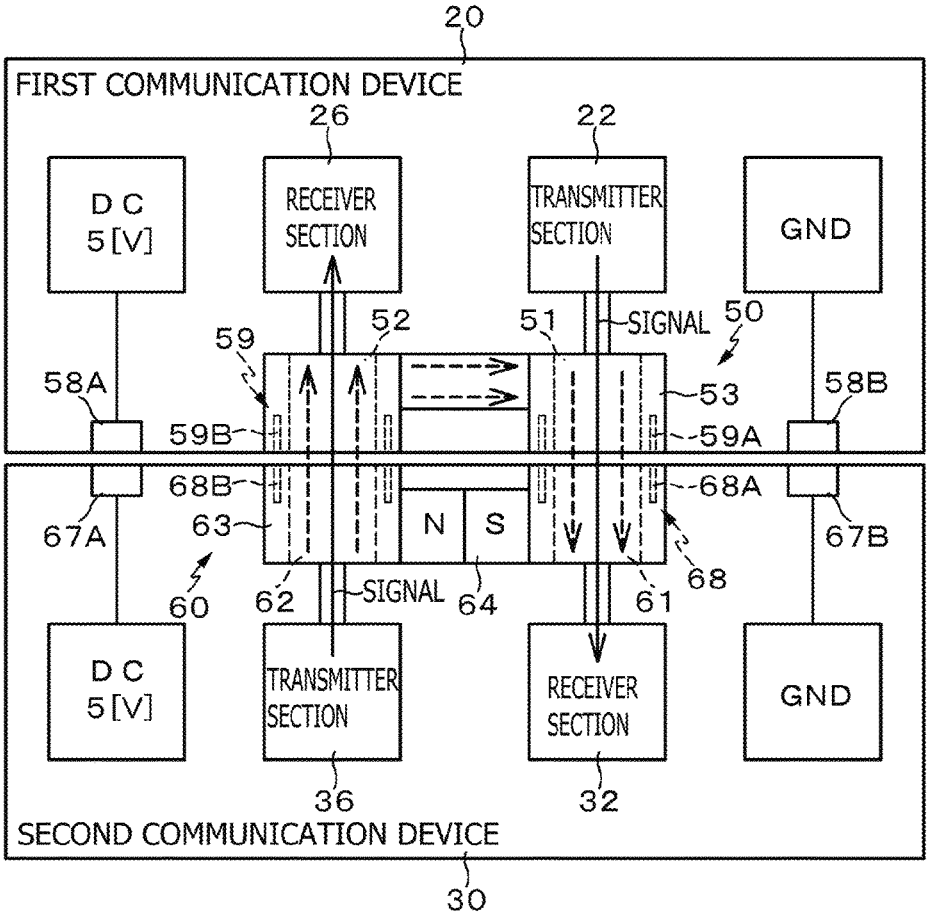
FIG. 16 is a schematic diagram illustrating a configuration of the connector device according to a ninth working example.

The connector device 40 according to a ninth working example is configured to suppress unwanted radiation (radio-wave leakage) by forming a choke structure for the millimeter-wave shield material 53 and the yoke 63, which double as waveguides. The fundamental structure of the connector device 40 according to the ninth working example is based on the structure of the connector device 40 according to the seventh working example, which is illustrated in FIG. 14. FIG. 16 is a schematic diagram illustrating a configuration of the connector device 40 according to the ninth working example.

Figure 17A:
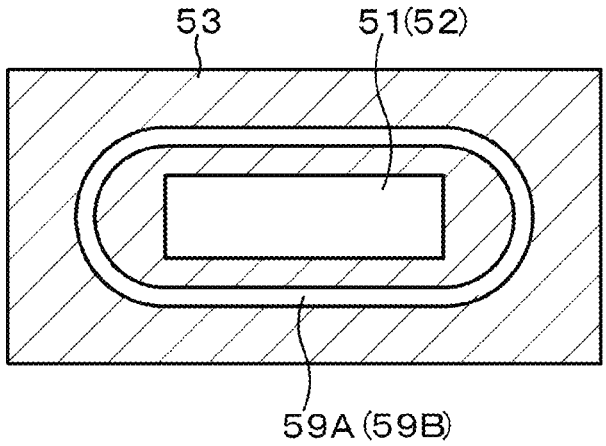
FIG. 17A is a diagram illustrating the relation between an annular groove and a waveguide shaped like a horizontally long rectangle.
Figure 17B:
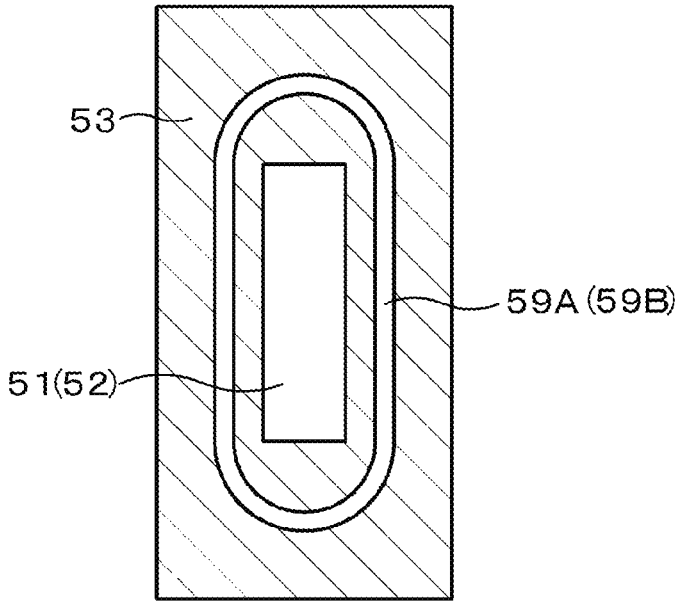
FIG. 17B is a diagram illustrating the relation between the annular groove and the waveguide shaped like a vertically long rectangle.

As depicted in FIG. 16, annular (e.g., elliptically annular) grooves 59A and 59B are formed around the central axis of the waveguides 51 and 52 and in the end face of the millimeter-wave shield material 53 that faces the yoke 63. These annular grooves 59A and 59B form a choke structure 59 of the first connector section 50 in order to suppress unwanted radiation (radio-wave leakage). FIGS. 17A and 17B illustrate the relation between the waveguide 51 (52) and the annular groove 59A (59B). FIG. 17A illustrates a case where the waveguide 51 (52) is shaped like a horizontally long rectangle. FIG. 17B illustrates a case where the waveguide 51 (52) is shaped like a vertically long rectangle.

As is the case with the first connector section 50, the second connector section 60 is configured so that annular (e.g., elliptically annular) grooves 68A and 68B are formed around the central axis of the waveguides 61 and 62 and in the end face of the yoke 63 that faces the millimeter-wave shield material 53. These annular grooves 68A and 68B form a choke structure 68 of the second connector section 60 in order to suppress unwanted radiation.

The choke structure 59 of the first connector section 50 is preferably formed so that the depth of the annular grooves 59A and 59B is set at $\lambda/4$, namely, ¼ the wavelength $\lambda$ of the high-frequency wave (millimeter wave in the present example) conveyed by the waveguides 51 and 52. The choke structure 68 of the second connector section 60 is also preferably formed so that the depth of the annular grooves 68A and 68B is set at $\lambda/4$. Further, the pitch of the grooves 59A and 59B and the pitch of the grooves 68A and 68B are preferably set at $\lambda/4$. Here, "$\lambda/4$" represents a value that is exactly $\lambda/4$ or substantially $\lambda/4$, and various variations caused by design or manufacture are permissible.

When, in a steady state, the depth of the grooves 59A and 59B and the grooves 68A and 68B is $\lambda/4$ in the choke structure 59 and the choke structure 68, an incident wave is in opposite phase to a reflected wave generated by the grooves 59A and 59B and the grooves 68A and 68B. Thus, the incident wave is canceled by the reflected wave generated by the grooves 59A and 59B and the grooves 68A and 68B. It signifies that the incident wave does not travel outward from the choke structures 59 and 68. Consequently, the connector device 40 according to the ninth working example can suppress unwanted radiation (radio-wave leakage to the outside).

The connector device 40 according to the ninth working example, which is configured as described above, is capable of forming the choke structure 59 and the choke structure 68 simply by forming the grooves 59A and 59B and the grooves 68A and 68B in the end faces (contact surfaces) of the millimeter-wave shield material 53 and the yoke 63. This eliminates the necessity of dedicated parts (additional parts) for suppressing unwanted radiation. Therefore, unwanted radiation can be suppressed while downsizing the connector device 40 and reducing the number of parts required for the connector device 40.

Further, the effect of unwanted-radiation suppression by the choke structures 59 and 68 makes it possible to achieve more stable signal transmission even if the contact portions between the first connector section 50 and the second connector section 60 are poor in reliability. Therefore, the signal transmission between the first connector section 50 and the second connector section 60 can be achieved even if dust enters between the first connector section 50 and the second connector section 60 or even if a nonmetal sheet formed, for example, of plastic, glass, or ceramic is sandwiched between the first connector section 50 and the second connector section 60.

When, for example, a plastic sheet is disposed on the contact surfaces of the first connector section 50 and the second connector section 60, the joint between the first connector section 50 and the second connector section 60 can be made waterproof and dustproof while increasing the degree of freedom of set design. Further, the choke structures 59 and 68 inhibit extraneous signals from entering the waveguides 51 and 52 and the waveguides 61 and 62, and thus provide improved immunity.

The present working example has been described on the assumption that the choke structure 59 and the choke structure 68 are respectively provided for the first connector section 50 and the second connector section 60. However, an alternative configuration may be formed by providing a choke structure for only one of the first connector section 50 and the second connector section 60. Further, the choke structures 59 and 68 are not limited to the above-described configuration. More specifically, the above-described configuration assumes that the grooves 59A and 59B and the grooves 68A and 68B have only one step (a single step). However, an alternative is to employ multiple-step grooves having two or more steps. Increasing the number of steps of the grooves 59A and 59B and the grooves 68A and 68B produces a greater effect of suppressing unwanted radiation and achieves the signal transmission even if a thicker nonmetal sheet is sandwiched.

Moreover, the technology according to the present working example, that is, the technology of suppressing unwanted radiation (radio-wave leakage) by forming the choke structures for the millimeter-wave shield material 53 and the yoke 63, which double as waveguides, is also applicable to the connector device 40 according to one of the first to eighth working examples.

Tenth Working Example

Figure 18:
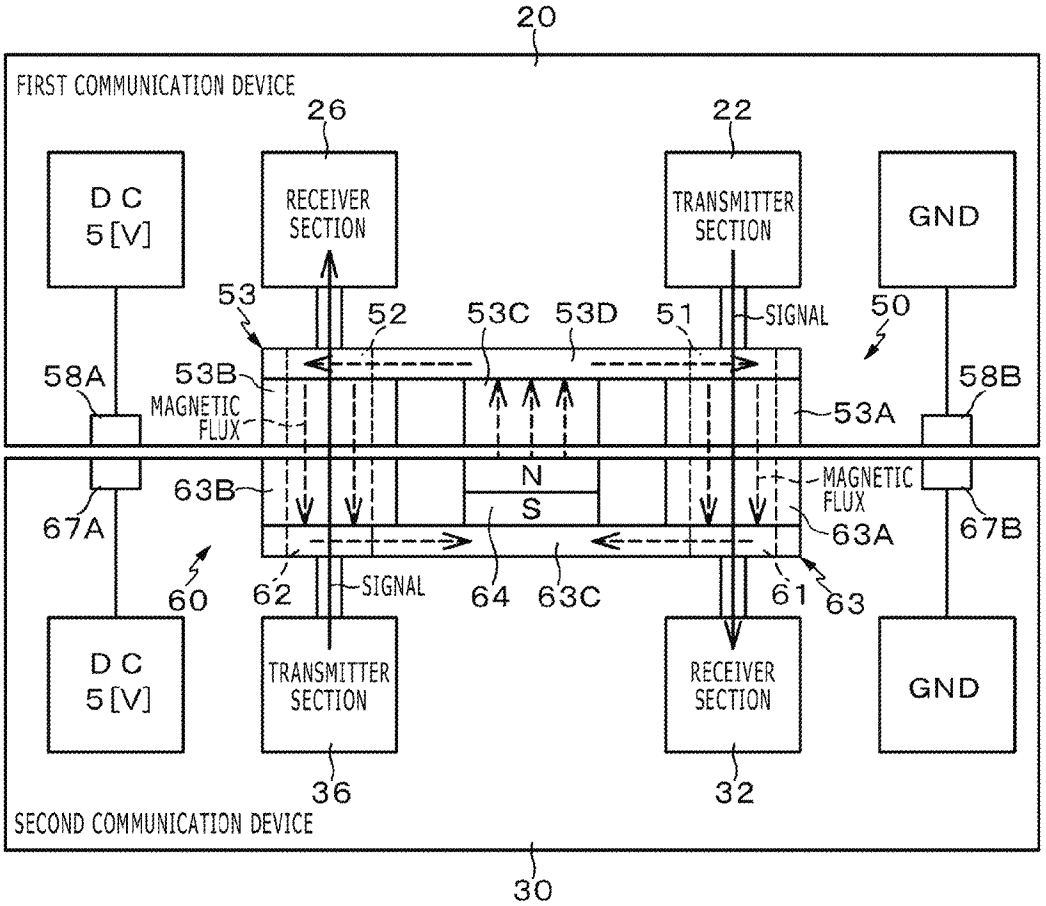
FIG. 18 is a schematic diagram illustrating a configuration of the connector device according to a tenth working example.

The connector device 40 according to a tenth working example is configured so as to increase the attractive force of the second connector section 60 for attracting the first connector section 50 by changing the layout of the magnet and yoke. The fundamental structure of the connector device 40 according to the tenth working example is based on the structure of the connector device 40 according to the seventh working example, which is illustrated in FIG. 14. FIG. 18 is a schematic diagram illustrating a configuration of the connector device 40 according to the tenth working example.

In the first connector section 50, the millimeter-wave shield material 53 includes a yoke 53A, a yoke 53B, an intermediate yoke 53C, and a coupling yoke 53D. The yoke 53A covers the waveguide 51. The yoke 53B covers the waveguide 52. The intermediate yoke 53C is disposed between the yoke 53A and the yoke 53B. The coupling yoke 53D magnetically couples the yoke 53A, the yoke 53B, and the intermediate yoke 53C to each other. In the second connector section 60, the yoke 63 includes a yoke 63A, a yoke 63B, and a yoke 63C. The yoke 63A covers the waveguide 61. The yoke 63B covers the waveguide 62. The yoke 63C magnetically couples the yoke 63A and the yoke 63B to each other. The magnet 64 is disposed so as to face the intermediate yoke 53C of the first connector section 50 and oriented so that the N- and S-poles are arrayed in the signal transmission direction.

In the second connector section 60, the magnet 64 and the yoke 63C form an attractive section that exerts an attractive force on the intermediate yoke 53C of the first connector section 50. This configuration forms a closed loop of magnetic flux as indicated by the broken-line arrows in FIG. 18. More specifically, the magnetic flux generated from the N-pole of the magnet 64 passes through the yoke 53C, then branches off in leftward and rightward directions in the drawing at the yoke 53D, and reaches the yoke 53A and the yoke 53B. Subsequently, the magnetic flux passes through the yoke 63A and the yoke 63B, then propagates through the yoke 63C, and returns to the S-pole of the magnet 64 to form the closed loop of magnetic flux.

In the connector device 40 according to the tenth working example, which is configured as described above, an attractive force is generated not only between the yoke 53A and the yoke 63A and between the yoke 53B and the yoke 63B, but also between the intermediate yoke 53C and the magnet 64. Therefore, the connector device 40 according to the tenth working example generates a stronger attractive force of the second connector section 60 for attracting the first connector section 50 than the connector device 40 according to the seventh working example, which generates an attractive force only between the yoke 53A and the yoke 63A and between the yoke 53B and the yoke 63B.

Eleventh Working Example

Figure 19:
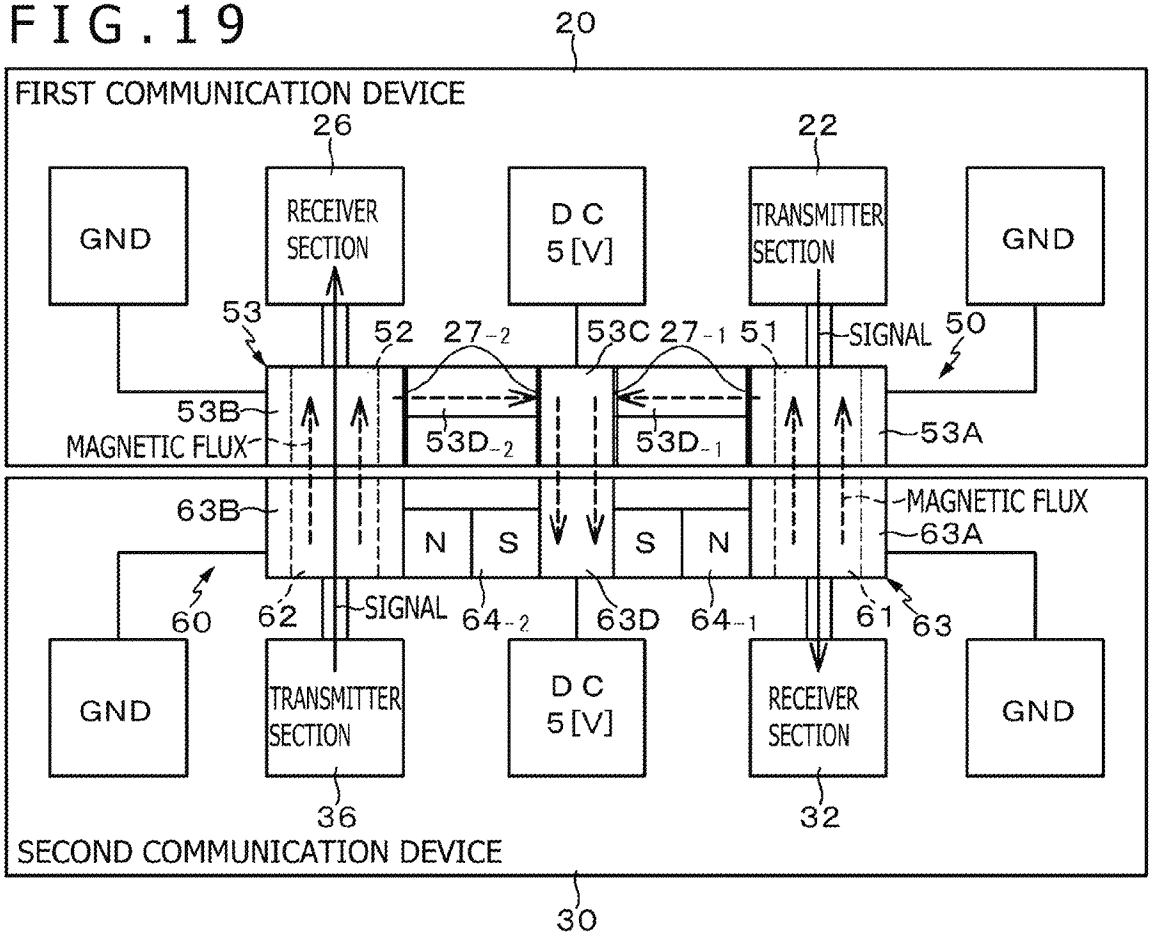
FIG. 19 is a schematic diagram illustrating a configuration of the connector device according to an eleventh working example.

An eleventh working example is a modification of the tenth working example. FIG. 19 is a schematic diagram illustrating a configuration of the connector device 40 according to the eleventh working example.

In the first connector section 50, the coupling yoke 53D, which magnetically couples the yoke 53A, the yoke 53B, and the intermediate yoke 53C to each other, is separated into a yoke 53$D_{-1}$ and a yoke 53$D_{-2}$. The yoke 53$D_{-1}$ is disposed between the yoke 53A and the yoke 53C. The yoke 53$D_{-2}$ is disposed between the yoke 53B and the yoke 53C. An insulating material 27$_{-1}$ electrically insulates the yoke 53$D_{-1}$ from the yokes 53A and 53C, and an insulating material 27$_{-2}$ electrically insulates the yoke 53$D_{-2}$ from the yokes 53B and 53C.

In the second connector section 60, an intermediate yoke 63D is disposed midway between the yoke 63A and the yoke 63B, that is, at a position facing the intermediate yoke 53C of the first connector section 50. Further, a magnet 64$_{-1}$ is disposed between the yoke 63A and the intermediate yoke 63D in such a manner that the S- and N-poles are arrayed in the direction orthogonal to the signal transmission direction. Additionally, a magnet 64$_{-2}$ is disposed between the yoke 63B and the intermediate yoke 63D in such a manner that the N- and S-poles are arrayed in the direction orthogonal to the signal transmission direction. The magnet 64$_{-1}$ and the magnet 64$_{-2}$ are arrayed so that the same magnetic poles face (the S-poles in the present example) each other.

In the second connector section 60, the intermediate yoke 63D and the two magnets 64$_{-1}$ and 64$_{-2}$ form an attractive section that exerts an attractive force on the intermediate yoke 53C of the first connector section 50. This configuration forms closed loops of magnetic flux as indicated by the broken-line arrows in FIG. 19. More specifically, the magnetic flux generated from the N-pole of the magnet 64$_{-1}$ passes through the yoke 63A and the yoke 53A, then propagates through the yoke 53$D_{-1}$, the yoke 53C, and the yoke 63D, and returns to the S-pole of the magnet 64$_{-1}$ to form a closed loop of magnetic flux. Further, the magnetic flux generated from the N-pole of the magnet 64$_{-2}$ passes through the yoke 63B and the yoke 53B, then propagates through the yoke 53$D_{-2}$, the yoke 53C, and the yoke 63D, and returns to the S-pole of the magnet 64$_{-2}$ to form another closed loop of magnetic flux.

In the present working example, the yokes 53A and 63A and the yokes 53B and 63B double as ground-potential (GND) power supply terminals between the first connector section 50 and the second connector section 60, and the yokes 53C and 63D double, for example, as 5-VDC power supply terminals.

In the connector device 40 according to the eleventh working example, which is configured as described above, an attractive force is generated not only between the yoke 53A and the yoke 63A and between the yoke 53B and the yoke 63B, but also between the yoke 53C and the yoke 63D. This also increases the attractive force of the second connector section 60 for attracting the first connector section 50.

Twelfth Working Example

Figure 20:
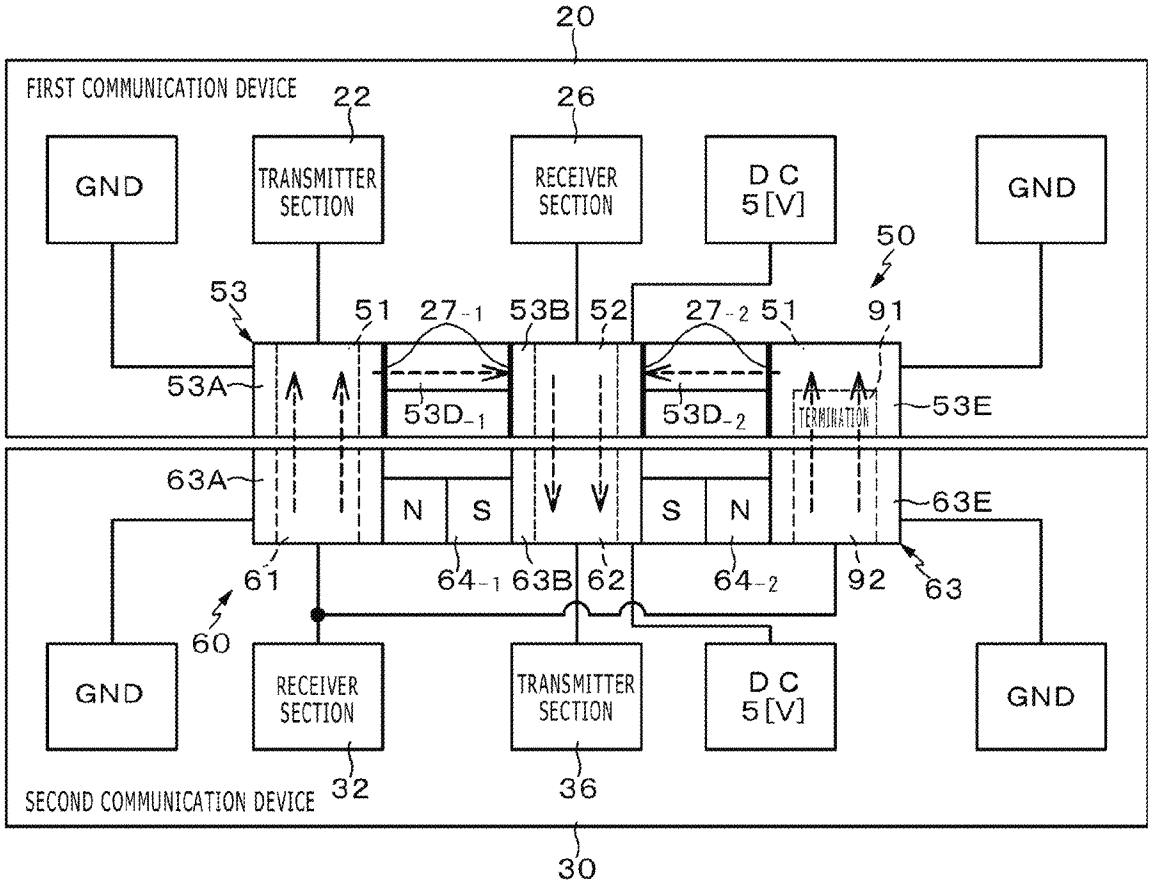
FIG. 20 is a schematic diagram illustrating a configuration of the connector device according to a twelfth working example.

The connector device 40 according to a twelfth working example is configured so that the second connector section 60 can be reversely inserted into the first connector section 50. FIG. 20 is a schematic diagram illustrating a configuration of the connector device 40 according to the twelfth working example.

As depicted in FIG. 20, the first connector section 50 includes three waveguides 51, 52 and 91, three yokes 53A, 53B and 53E, and coupling yokes 53$D_{-1}$ and 53$D_{-2}$. The three yokes 53A, 53B and 53E respectively cover the three waveguides 51, 52 and 91. The coupling yokes 53$D_{-1}$ and 53$D_{-2}$ magnetically couple the three yokes 53A, 53B and 53E to each other. The first connector section 50 is configured to use the intermediate one 52 of the three waveguides 51, 52 and 91, for example, for reception purposes, and use one (e.g., waveguide 51) of the remaining waveguides 51 and 91, which are disposed at opposing ends, for transmission purposes.

The second connector section 60 includes three waveguides 61, 62 and 92, three yokes 63A, 63B and 63E, and two magnets 64$_{-1}$ and 64$_{-2}$. The three waveguides 61, 62 and 92 respectively correspond to the three waveguides 51, 52 and 91 of the first connector section 50. The three yokes 63A, 63B and 63E respectively cover the three waveguides 61, 62 and 92. The two magnets 64$_{-1}$ and 64$_{-2}$ are disposed between the three yokes 63A, 63B and 63E. While the first connector section 50 uses the intermediate waveguide 52 for reception purposes, the second connector section 60 uses the intermediate waveguide 62 for transmission purposes and uses both of the remaining waveguides 61 and 92, which are disposed at opposing ends, for reception purposes.

In the connector device 40 according to the twelfth working example, which is configured as described above, the waveguides 61 and 92 at opposing ends of the second connector section 60 are provided for reception purposes. Thus, the second connector section 60 can be reversely mounted onto the first connector section 50 (so-called reverse insertion) for establishing communication. While an expression "normally mounted" signifies a mounted state in which the transmission waveguide 51 of the first connector section 50 faces the reception waveguide 61 of the second connector section 60 (the state depicted in FIG. 20), the expression "reversely mounted" signifies a mounted state in which the transmission waveguide 51 of the first connector section 50 faces the reception waveguide 92 of the second connector section 60.

As described above, communication can be established no matter whether the second connector section 60 is mounted normally or reversely onto the first connector section 50. This saves a user the bother of paying attention to the orientations of the first connector section 50 and the second connector section 60 when they are to be attached to each other. Consequently, the connector device 40 is user-friendly. Further, when an end of the waveguide 91 in the present example, namely, an end of an unused waveguide of the first connector section 50 that is positioned opposite the other end to be coupled to the second connector section 60, is blocked to form a termination structure, better transmission characteristics are provided than without the termination structure.

The present working example assumes that the intermediate waveguide 52 of the first connector section 50 is used for reception purposes. However, the intermediate waveguide 52 may alternatively be used for transmission purposes. When such an alternative scheme is employed, the second connector section 60 uses the intermediate waveguide 62 for reception purposes and uses the remaining waveguides 61 and 92 at both ends for transmission purposes.

<Modifications>

While the technology according to the present disclosure has been described in terms of the preferred embodiment, the technology according to the present disclosure is not limited to the preferred embodiment. The configurations and structures of the connector device and the communication system described in the above embodiment are merely described for illustrative purposes and may be changed as appropriate. For example, the foregoing embodiment has been described on the assumption that two-way communication is established by allowing the first connector section 50 to include the two waveguides 51 and 52 and the second connector section 60 to include the two waveguides 61 and 62. However, the application of the foregoing embodiment is not limited to two-way communication. More specifically, the foregoing embodiment is also applicable to one-way communication. Further, the number of waveguides may be increased to achieve multi-channeling. In this case, radio-wave interference between multi-channels can be avoided, for example, by the shield member 65 formed of a rubber elastic body and by the choke structures 59 and 68.

The present disclosure may adopt the following configurations.

(1) A connector device including:

a first connector section that has a waveguide for transmitting a high-frequency signal; and a second connector section that has a waveguide for transmitting a high-frequency signal, a yoke disposed to cover the waveguide, and a magnet forming a magnetic circuit with the yoke, and is couplable to the first connector section by an attractive force of the magnet.

(2) The connector device as described in (1) above, wherein the second connector section includes a shield member that is formed of a rubber elastic body, disposed between the yoke and the magnet, and protruded from end faces of the yoke and the magnet.

(3) The connector device as described in (2) above, wherein the waveguide of the first connector section is covered with a shield material formed of a magnetic body.

(4) The connector device as described in any one of (1) to (3) above, wherein a part of the yoke of the second connector section is disposed to cover the periphery of the magnet.

(5) The connector device as described in (1) above, wherein the first connector section is disposed to allow a magnet to cover the periphery of a yoke, and includes a shield member formed of a rubber elastic body and disposed between the yoke and the magnet.

(6) The connector device as described in (5) above, wherein the shield member of the first connector section is not protruded from end faces of the yoke and the magnet.

(7) The connector device as described in any one of (1) to (6) above, wherein the first connector section and the second connector section include a power supply terminal that supplies electrical power between the first connector section and the second connector section.

(8) The connector device as described in (3) above, wherein the shield material of the first connector section and the yoke of the second connector section double as a power supply terminal for supplying electrical power between the first connector section and the second connector section.

(9) The connector device as described in any one of (2) to (8) above, wherein at least either a yoke of the first connector section or the yoke of the second connector section has a choke structure built by forming an annular groove around the waveguide.

(10) The connector device as described in (9) above, wherein the depth of the groove in the choke structure is ¼ the wavelength of the high-frequency signal.

(11) The connector device as described in (1) above, wherein the first connector section includes two waveguides, two yokes for covering the two respective waveguides, an intermediate yoke disposed between the two yokes, and a coupling yoke for magnetically coupling the two yokes to the intermediate yoke; and the second connector section includes two waveguides corresponding to the two waveguides of the first connector section, two yokes for covering the two respective waveguides, and an attractive section for exerting an attractive force on the intermediate yoke of the first connector section.

(12) The connector device as described in (11) above, wherein the attractive section of the second connector section includes a magnet disposed between the two yokes and a yoke for magnetically coupling each of the two yokes to the magnet.

(13) The connector device as described in (11) above, wherein the attractive section of the second connector section includes an intermediate yoke disposed between the two yokes, and two magnets disposed between the two yokes and the intermediate yoke.

(14) The connector device as described in (1) above, wherein the first connector section includes three waveguides, three yokes for covering the three respective waveguides, and a coupling yoke for magnetically coupling the three yokes, uses an intermediate one of the three waveguides for reception or transmission purposes, and uses a waveguide at either end for transmission or reception purposes;

the second connector section includes three waveguides corresponding to the three waveguides of the first connector section, three yokes for covering the three respective waveguides, and two magnets disposed between the three yokes;

when the first connector section uses the intermediate waveguide for reception purposes, the second connector section uses an intermediate one of the three waveguides for transmission purposes and uses the waveguides at both ends for reception purposes; and when the first connector section uses the intermediate waveguide for transmission purposes, the second connector section uses the intermediate one of the three waveguides for reception purposes and uses the waveguides at both ends for transmission purposes.

(15) The connector device as described in (14) above, wherein the remaining waveguide disposed at either end of the first connector section has a termination structure, the termination structure being formed to block an end of the waveguide that is positioned opposite the other end to be coupled to the second connector section.

(16) The connector device as described in any one of (1) to (15) above, wherein the high-frequency signal is a millimeter-wave band signal.

(17) A communication system including:

two communication devices; and a connector device for transmitting a high-frequency signal between the two communication devices;

the connector device including a first connector section having a waveguide for transmitting the high-frequency signal, and a second connector section that has a waveguide for transmitting the high-frequency signal, a yoke disposed to cover the waveguide, and a magnet forming a magnetic circuit with the yoke, and is couplable to the first connector section by an attractive force of the magnet.

(18) The communication system as described in (17) above, wherein the high-frequency signal is a millimeter-wave band signal.

REFERENCE SIGNS LIST

10 Communication system, 20 First communication device, 30 Second communication device, 21, 31 Housing, 22, 36 Transmitter section, 23, 33 Waveguide, 24, 50 First connector section, 25, 35, 40 Connector device, 26, 32 Receiver section, 34, 60 Second connector section, 51, 52, 61, 62, 91, 92 Millimeter-wave waveguide, 53 Millimeter-wave shield material, 59, 68 Choke structure

63 Yoke, 64, 64$_{-1}$, 64$_{-2}$ Magnet, 65 Shield member

The invention claimed is:

1. A connector device, comprising:

a first connector section that comprises a first waveguide configured to transmit a high-frequency signal; and a second connector section that comprises:

a second waveguide configured to transmit the high-frequency signal;

a second yoke that covers the second waveguide;

a second magnet configured to:

form a magnetic circuit with the second yoke; and couple to the first connector section based on an attractive force of the second magnet; and a second shield member between the second yoke and the second magnet, wherein the second shield member is of a rubber elastic body and protrudes from a first end face of the second yoke and a second end face of the second magnet.

2. The connector device according to claim 1, wherein the first connector section further comprises a first shield member that covers the first waveguide of the first connector section, and the first shield member is of a magnetic body.

3. The connector device according to claim 2, wherein the first shield member of the first connector section and the second yoke of the second connector section are further configured as a power supply terminal to supply electrical power between the first connector section and the second connector section.

4. The connector device according to claim 1, wherein a part of the second yoke of the second connector section covers a periphery of the second magnet.

5. The connector device according to claim 1, wherein the first connector section further comprises:

a first yoke;

a first magnet that covers a periphery of the first yoke; and a first shield member between the first yoke and the first magnet, wherein the first shield member is of a rubber elastic body.

6. The connector device according to claim 5, wherein the first shield member of the first connector section is not protruded from an end face of the first yoke and an end face of the first magnet.

7. The connector device according to claim 1, wherein the first connector section further comprises a first power supply terminal and the second connector section further comprises a second power supply terminal, and the first power supply terminal and the second power supply terminal are configured to supply electrical power between the first connector section and the second connector section.

8. The connector device according to claim 1, wherein the high-frequency signal is a millimeter-wave band signal.

9. The connector device according to claim 1, wherein the first connector section further comprises a first yoke that comprises a first choke structure comprising a first annular groove around the first waveguide, and the second yoke comprises a second choke structure comprising a second annular groove around the second waveguide.

10. The connector device according to claim 9, wherein a depth of at least one of the first annular groove and the second annular groove is ¼ a wavelength of the high-frequency signal.

11. The connector device according to claim 1, wherein the first connector section further includes:

a third waveguide;

a first yoke that covers the first waveguide;

a third yoke that covers the third waveguide;

a first intermediate yoke between the first yoke and the third yoke; and a coupling yoke that magnetically couples the first yoke and the third yoke to the first intermediate yoke, and the second connector section further includes:

a fourth waveguide corresponding to the third waveguide of the first connector section, wherein the second waveguide corresponds to the first waveguide of the first connector section;

a fourth yoke that covers the fourth waveguide; and an attractive section that exerts an attractive force on the first intermediate yoke of the first connector section.

12. The connector device according to claim 11, wherein the attractive section of the second connector section includes:

a third magnet between the second yoke and the fourth yoke; and a fifth yoke that magnetically couples the second yoke and the fourth yoke to the third magnet.

13. The connector device according to claim 11, wherein the attractive section of the second connector section includes:

a second intermediate yoke between the second yoke and the fourth yoke;

a fourth magnet between the second yoke and the second intermediate yoke; and a fifth magnet between the fourth yoke and the second intermediate yoke.

14. The connector device according to claim 1, wherein the first connector section comprises:

three waveguides including the first waveguide;

three yokes that cover the three respective waveguides; and a coupling yoke that magnetically couples the three yokes, the first connector section is further configured to:

use an intermediate waveguide of the three waveguides for one of reception or transmission; and use a fifth waveguide of the three waveguides for one of the transmission or the reception, wherein the fifth waveguide is at a first end of the first connector section, the second connector section includes:

three waveguides including the second waveguide corresponding to the three waveguides of the first connector section;

three yokes including the second yoke that cover the three respective waveguides of the second connector section; and two magnets including the second magnet disposed between the three yokes of the second connector section, when the first connector section is configured to use the intermediate waveguide for the reception, the second connector section is further configured to use an intermediate waveguide of the three waveguides of the second connector section for the transmission and use the remaining waveguides of the three waveguides of the second connector section for the reception, wherein the remaining waveguides are at both ends of the second connector section, and when the first connector section is configured to use the intermediate waveguide for the transmission, the second connector section is further configured to use the intermediate waveguide of the three waveguides of the second connector section for the reception and use the remaining waveguides of the three waveguides of the second connector section for the transmission.

15. The connector device according to claim 14, wherein a sixth waveguide of the three waveguides of the first connector section comprises a termination structure, the sixth waveguide is at a second end of the first connector section opposite to the first end of the first connector section, the termination structure blocks a third end of the sixth waveguide, the third end of the sixth waveguide is opposite to a fourth end of the sixth waveguide, and the fourth end of the sixth waveguide is coupled to the second connector section.

16. A connector device, comprising:

a first connector section that comprises:

a first waveguide configured to transmit a high-frequency signal;

a first yoke;

a first magnet that covers a periphery of the first yoke; and a shield member between the first yoke and the first magnet, wherein the shield member is of a rubber elastic body; and a second connector section that comprises:

a second waveguide configured to transmit the high-frequency signal;

a second yoke that covers the second waveguide; and a second magnet configured to:

form a magnetic circuit with the second yoke; and couple to the first connector section based on an attractive force of the second magnet.

17. A communication system, comprising:

a first communication device;

a second communication device; and a connector device configured to transmit a high-frequency signal between the first communication device and the second communication device, wherein the connector device comprises:

a first connector section that comprises a first waveguide configured to transmit the high-frequency signal; and a second connector section that comprises:

a second waveguide configured to transmit the high-frequency signal;

a yoke that covers the second waveguide;

a magnet configured to:

form a magnetic circuit with the yoke; and couple to the first connector section based on an attractive force of the magnet; and a shield member between the yoke and the magnet, wherein the shield member is of a rubber elastic body and protrudes from a first end face of the yoke and a second end face of the magnet.

18. The communication system according to claim 17, wherein the high-frequency signal is a millimeter-wave band signal.

19. A connector device, comprising:

a first connector section that comprises:

a first waveguide configured to transmit a high-frequency signal; and a first power supply terminal; and a second connector section that comprises:

a second waveguide configured to transmit the high-frequency signal;

a second yoke that covers the second waveguide;

a second magnet configured to:

form a magnetic circuit with the second yoke; and couple to the first connector section based on an attractive force of the second magnet; and a second power supply terminal, wherein the first power supply terminal and the second power supply terminal are configured to supply electrical power between the first connector section and the second connector section.

* * * * *